US005628237A

United States Patent [19]

Lindee et al.

[11] Patent Number: 5,628,237

[45] Date of Patent: May 13, 1997

[54] SLICING MACHINE FOR TWO OR MORE FOOD LOAVES

[75] Inventors: Scott A. Lindee, New Lenox; Glenn A. Sandberg, Lockport; Wilbur A. Janssen, New Lenox, all of Ill.

[73] Assignee: Formax, Inc., Mokena, Ill.

[21] Appl. No.: 320,759

[22] Filed: Oct. 11, 1994

[51] Int. Cl.[6] ..... B26D 7/06

[52] U.S. Cl. ..... 83/403.1; 83/409; 83/422; 83/932

[58] Field of Search ..... 83/722, 932, 277, 83/403.1, 409, 409.1, 422

[56] References Cited

U.S. PATENT DOCUMENTS

| | | | |
|---|---|---|---|
| 2,036,001 | 3/1936 | Walter . | |
| 2,038,864 | 4/1936 | Walter . | |
| 2,126,458 | 8/1938 | Englen . | |
| 2,768,666 | 10/1956 | Garapolo et al. . | |
| 2,834,388 | 5/1958 | Mayer . | |
| 2,966,186 | 12/1960 | Garapolo . | |
| 3,208,321 | 9/1965 | Holt . | |
| 3,605,837 | 9/1971 | Lambert et al. . | |
| 3,821,913 | 7/1974 | Bajcar et al. . | |
| 3,827,319 | 8/1974 | Flesch . | |
| 3,842,698 | 10/1974 | Fitch et al. | 83/88 |
| 3,846,957 | 11/1974 | Divan . | |
| 3,894,457 | 7/1975 | Miller et al. . | |
| 3,965,783 | 6/1976 | Muller et al. . | |
| 3,972,256 | 8/1976 | Ross . | |
| 3,995,517 | 12/1976 | Smith . | |
| 4,151,772 | 5/1979 | Johnson . | |
| 4,309,927 | 1/1982 | Dennis et al. . | |
| 4,405,186 | 9/1983 | Sandberg et al. | 83/77 |
| 4,428,263 | 1/1984 | Lindee et al. . | |
| 4,532,840 | 8/1985 | Antonissen . | |
| 4,572,044 | 2/1986 | Antonissen . | |
| 4,644,729 | 2/1987 | Fessler | 83/277 |
| 4,794,996 | 1/1989 | Wallace . | |
| 4,941,375 | 7/1990 | Kasper . | |
| 5,033,341 | 7/1991 | Mussig et al. | 83/18 |
| 5,054,345 | 10/1991 | Weber . | |
| 5,101,702 | 4/1992 | Kuchler . | |
| 5,191,820 | 3/1993 | Hartmann | 83/277 |

*Primary Examiner*—Kenneth E. Peterson

*Attorney, Agent, or Firm*—Dorn, McEachran, Jambor & Keating

[57] ABSTRACT

A high speed slicing machine supports first and second food loaves for movement along parallel loaf paths into a slicing station where both loaves are sliced by one cyclically driven knife blade; the slices are stacked or shingled in groups on a receiving conveyor located below the slicing station. Independent loaf feed drives are provided; slices cut from one loaf may be thicker than slices from the other. The machine combines manual and automated mechanisms to load food loaves onto the food paths. These mechanisms share a central barrier that is used only during loading; at other times the barrier is clear of the loaf paths. The automated loaf loading mechanism has a sweep to push one or more loaves onto a support defining the loaf paths. There are two grippers, one on each loaf path; each grips the end of a loaf remote from the slicing station. For each gripper, a loaf feed drive impels the gripper (and loaf) toward the slicing station and then moves the gripper back to a home position, releasing an unsliced loaf butt on the way through a door opening in the loaf support. Each loaf feed drive includes two "short" conveyors driven at the same speed as the gripper. The loaf support is pivotally movable to a cleanup position; in its normal support position the loaf support masks the grippers, the loaf feed drive, the barrier, and the sweeps, but in cleanup position it exposes them all.

22 Claims, 18 Drawing Sheets

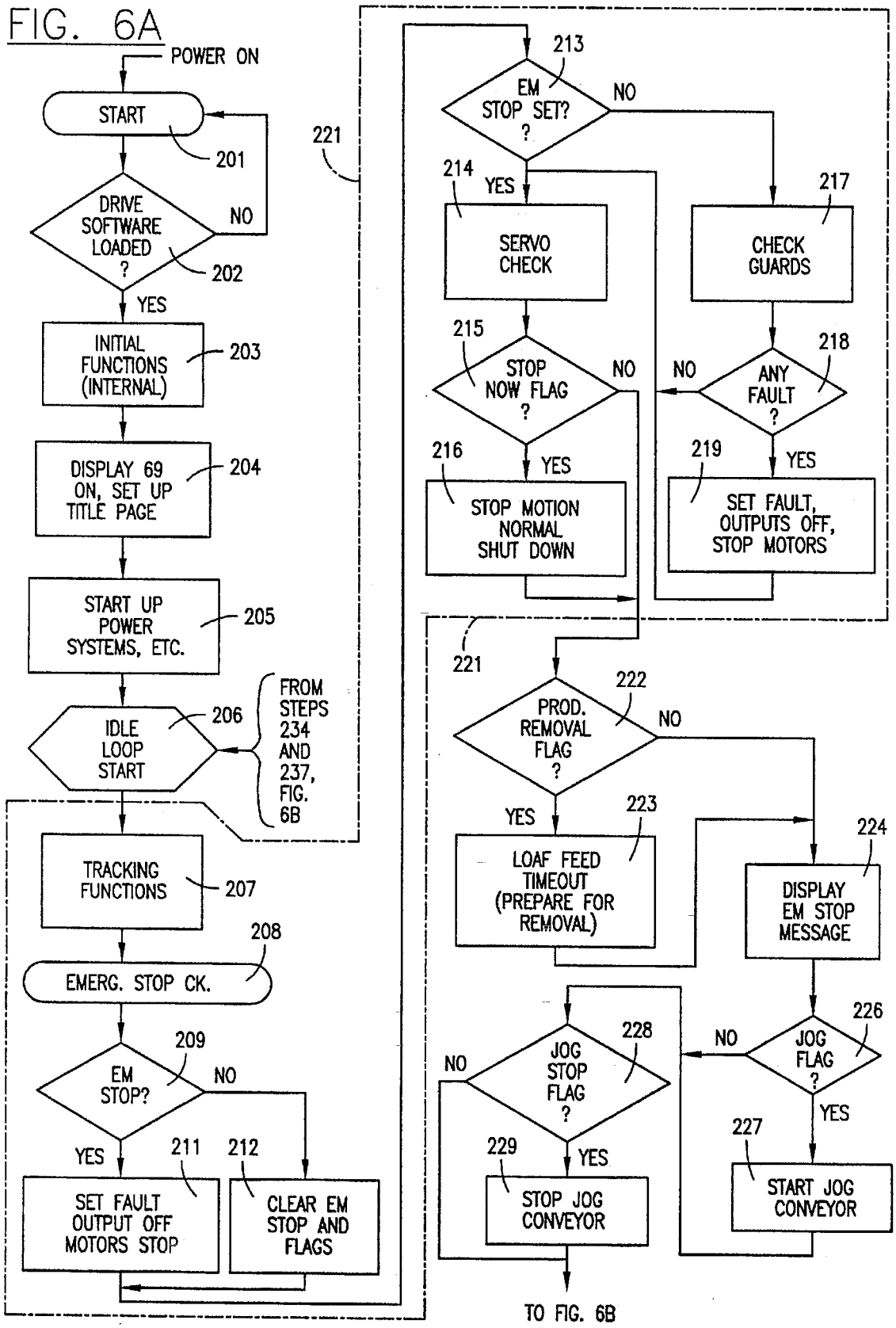
FIG. 6A
POWER ON
START
201
DRIVE SOFTWARE LOADED ?
202
NO
YES
INITIAL FUNCTIONS (INTERNAL)
203
DISPLAY 69 ON, SET UP TITLE PAGE
204
START UP POWER SYSTEMS, ETC.
205
IDLE LOOP START
206
FROM STEPS 234 AND 237, FIG. 6B
TRACKING FUNCTIONS
207
208
EMERG. STOP CK.
209
EM STOP?
NO
YES
211
212
SET FAULT OUTPUT OFF MOTORS STOP
CLEAR EM STOP AND FLAGS
221
213
EM STOP SET? ?
NO
214
YES
SERVO CHECK
217
CHECK GUARDS
215
STOP NOW FLAG ?
NO
NO
218
ANY FAULT ?
216
YES
STOP MOTION NORMAL SHUT DOWN
219
YES
SET FAULT, OUTPUTS OFF, STOP MOTORS
221
222
PROD. REMOVAL FLAG ?
NO
YES
223
LOAF FEED TIMEOUT (PREPARE FOR REMOVAL)
224
DISPLAY EM STOP MESSAGE
226
JOG FLAG ?
NO
YES
228
JOG STOP FLAG ?
NO
229
YES
STOP JOG CONVEYOR
227
START JOG CONVEYOR
TO FIG. 6B

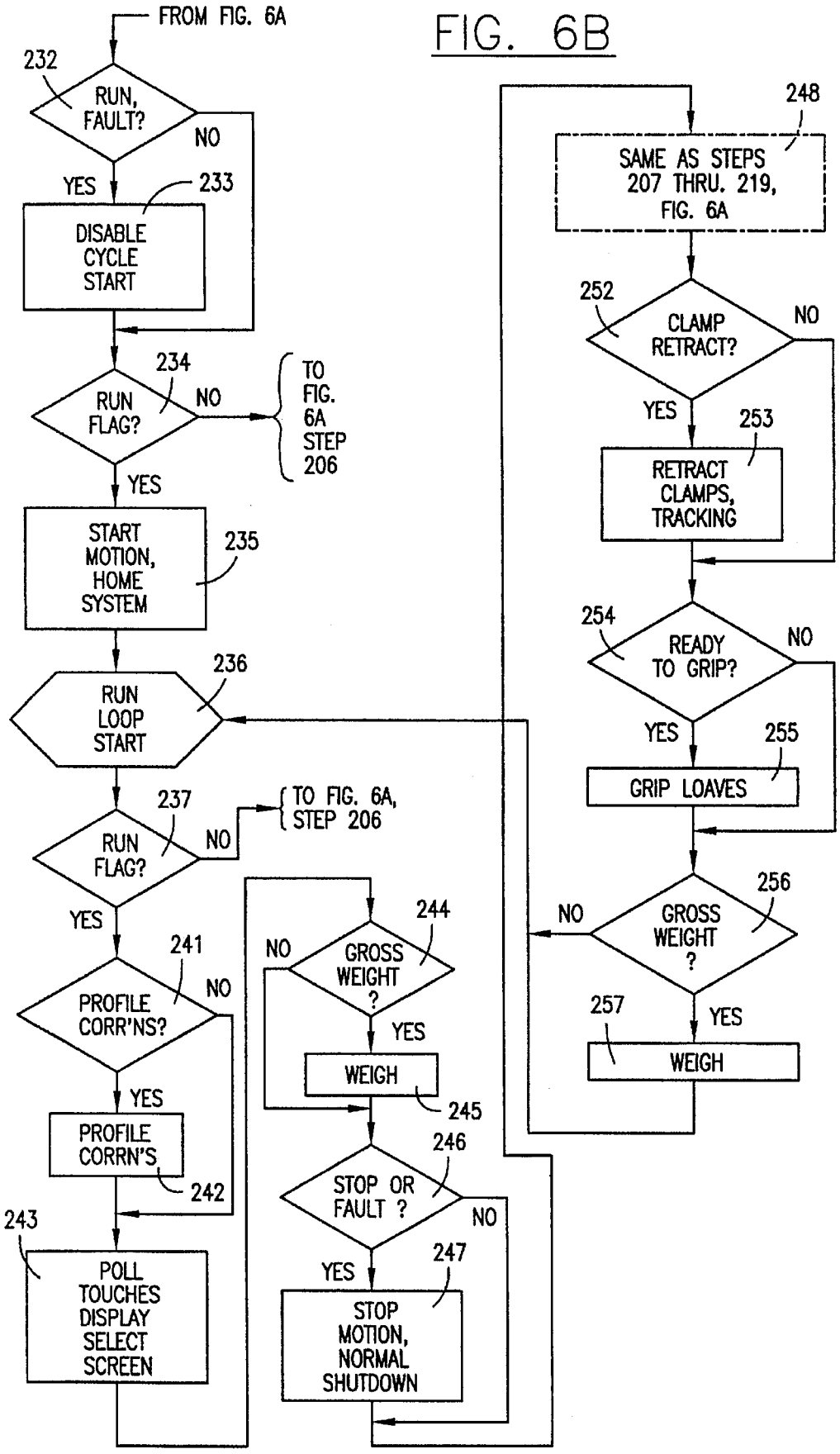
FIG. 6B
FROM FIG. 6A
232
RUN, FAULT?
NO
YES
233
DISABLE CYCLE START
234
RUN FLAG?
NO
TO FIG. 6A STEP 206
YES
START MOTION, HOME SYSTEM
235
236
RUN LOOP START
237
RUN FLAG?
NO
TO FIG. 6A, STEP 206
YES
241
PROFILE CORR'NS?
NO
YES
PROFILE CORRN'S
242
243
POLL TOUCHES DISPLAY SELECT SCREEN
244
GROSS WEIGHT ?
NO
YES
WEIGH
245
246
STOP OR FAULT ?
NO
YES
247
STOP MOTION, NORMAL SHUTDOWN
248
SAME AS STEPS 207 THRU. 219, FIG. 6A
252
CLAMP RETRACT?
NO
YES
253
RETRACT CLAMPS, TRACKING
254
READY TO GRIP?
NO
YES
255
GRIP LOAVES
256
GROSS WEIGHT ?
NO
YES
257
WEIGH 308
114
75
121A
13
308
373
371
66
358
359
351
355
166
182
124
390
K
309
123
121
116
309
167
149
M
377
117
126
118
327
326
334
125A
128
118A
325
113
13
180
372
164

371
373
114
308
358
167
354
351
M
359
357
353
124
166
182
356
377
309
121
355
375
151A
376
J
66
381A
597
117
347
126
149
345
128
125
164
337
181
113

GRIPPER ACTUATED

GRIPPER ACTUATED

GRIPPER NOT ACTUATED

SLICING MACHINE FOR TWO OR MORE FOOD LOAVES

BACKGROUND OF THE INVENTION

Many different kinds of food loaves are produced; they come in a wide variety of shapes and sizes. There are meat loaves made from various different meats, including ham, pork, beef, lamb, turkey, fish, and even meats not usually mentioned. The meat in the food loaf may be in large pieces or may be thoroughly comminuted. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Many of these food loaves meet a common fate; they are sliced, the slices are grouped in accordance with a particular weight requirement, and the groups of slices are packaged and sold at retail. The number of slices in a group may vary, depending on the size and consistency of the food loaf and even on the whim of the producer, the wholesaler, or the retailer. For some products, neatly aligned stacked slice groups are preferred. For others, the groups should be shingled so that a purchaser can see a part of every slice through a transparent package. And when it comes to bacon or other food products of variable shape, the problems do not just increase; they literally multiply.

A variety of different known slicing machines have been used to slice food loaves. They range from small, manually fed slicers used in butcher shops and in retail establishments to large, high speed slicers usually employed in meat processing plants. The present invention is directed to a high speed slicing machine used in a meat processing plant.

Some known high speed food loaf slicing machines have provided for slicing two food loaves simultaneously with a single, cyclically driven knife blade. Other prior high speed slicing machines, including that shown in S. Lindee et al. U.S. Pat. No. 4,428,263, have sliced one loaf at a time, but could be expanded to slice two or more loaves simultaneously. But none of the prior high speed slicing machines have had the versatility needed to slice food loaves of the many different sizes and shapes referred to above, particularly with provision for either stacking or shingling of the sliced output, variations in slice thickness and slice count from two different loaves, and precision control of the weight of slice groups.

SUMMARY OF THE INVENTION

It is a principal object of the present invention to provide a new and improved versatile high speed slicing machine, capable of slicing one, two, or more food loaves with a single cyclically driven knife, a slicing machine that can be loaded automatically or manually, that can accommodate food loaves having wide variations in dimensions, and that can vary the slice thickness and slice count for groups of slices simultaneously cut from different loaves.

Another object of the invention is to provide a new and improved versatile high speed slicing machine having automated loaf loading and loaf feed mechanisms that can handle food loaves of many different sizes and shapes.

A further object of the invention is to provide a new and improved versatile high speed slicing machine incorporating self-correcting precision control, preferably with internal computer control, so that the slicing machine output is adapted to a broad range of end use requirements.

A specific object of the invention is to provide a new and improved gripper construction for a positive loaf feed mechanism in a high speed food loaf slicing machine, a gripper mechanism that permits use with broad ranges of food loaf sizes and end use requirements yet facilitates use with a set home position for the gripper for each new food loaf cycle.

These and other objects of the invention are realizable with the present invention as described more fully hereinafter.

Accordingly, the invention relates to an improved high speed food loaf slicing machine comprising a slicing station including a knife blade and a knife blade drive driving the knife blade along a predetermined cutting path, and loaf support means for supporting a first food loaf and a second food loaf for movement along parallel first and second loaf paths, respectively, into the slicing station for repetitive slicing of both loaves by the knife blade.

In one aspect of the invention, the improvement comprises a first loaf feed drive for advancing the first food loaf along the first loaf path at a first preselected loaf feed rate, and a second loaf feed drive for advancing the second food loaf along the second loaf path at a second preselected loaf feed rate. Further, the improvement includes means for varying one loaf feed rate independently of the other so that slices cut from one loaf can differ in thickness from slices cut from the other.

In another aspect, the improvement of the invention includes an automated loaf loading mechanism comprising a first loaf storage tray for storing a food loaf ready for transfer to a loaf path, and first loaf transfer means for moving a food loaf from the first loaf storage tray to a loaf path.

In a further aspect of the invention, the improvement comprises a first loaf gripper, on the first loaf path, actuatable between a gripping condition, in which the first gripper engages and grips the end of the first food loaf remote from the slicing station, on the first loaf path, and a release condition disengaged from the first loaf. There is a second loaf gripper, on the second loaf path, also actuatable between a gripping condition gripping a second food loaf and a release condition. The first and second grippers are actuatable independently of each other.

In yet another aspect of the invention, the improvement comprises an elongated barrier aligned between and parallel to the first and second loaf paths. Barrier displacement means are provided for displacing the barrier between a first position between food loaves on the food paths and a second position clear of food loaves on the food paths.

In still another aspect of the invention, the improvement comprises a first pair of short feed conveyors engaging opposite sides of a first food loaf along the portion of the first loaf path immediately adjacent the slicing station. A second pair of short feed conveyors engage opposite sides of a second food loaf along the portion of the second loaf path immediately adjacent the slicing station.

In yet a further aspect of the invention, the loaf support means comprises first and second aligned supports separated from each other, in a direction parallel to the food paths, by a discharge space. There is a third support movable between a normal closed position in which the third support fills the discharge space and an open position in which the discharge space is open between the first and second supports. This improvement includes actuating means for moving the third support member to its open position following completion of slicing of a food loaf and subsequently returning the third support to its normal closed position.

A subcombination of the invention, for use in a high speed slicing machine as previously referred to, is a gripper that comprises a sensor for sensing engagement of the gripper with the end of a food loaf as the gripper moves along a food path toward the slicing station. The gripper includes at least two gripping elements each actuatable between a loaf end gripping position and a release position. There is also a gripping element actuator, responsive to the sensor, for actuating the gripping elements to their gripping positions when the sensor senses engagement with the end of a food loaf, and for actuating the gripping elements to their release positions when the gripper moves back along the food path.

BRIEF DESCRIPTION OF THE DRAWINGS

In the Drawings:

FIGS. 6A and 6B jointly comprise a flow chart for a computer control used in the slicing machine of FIGS. 1–5;

DESCRIPTION OF THE PREFERRED EMBODIMENTS

A. The Basic Slicing Machine, FIGS. 1–5.

Figure 1:
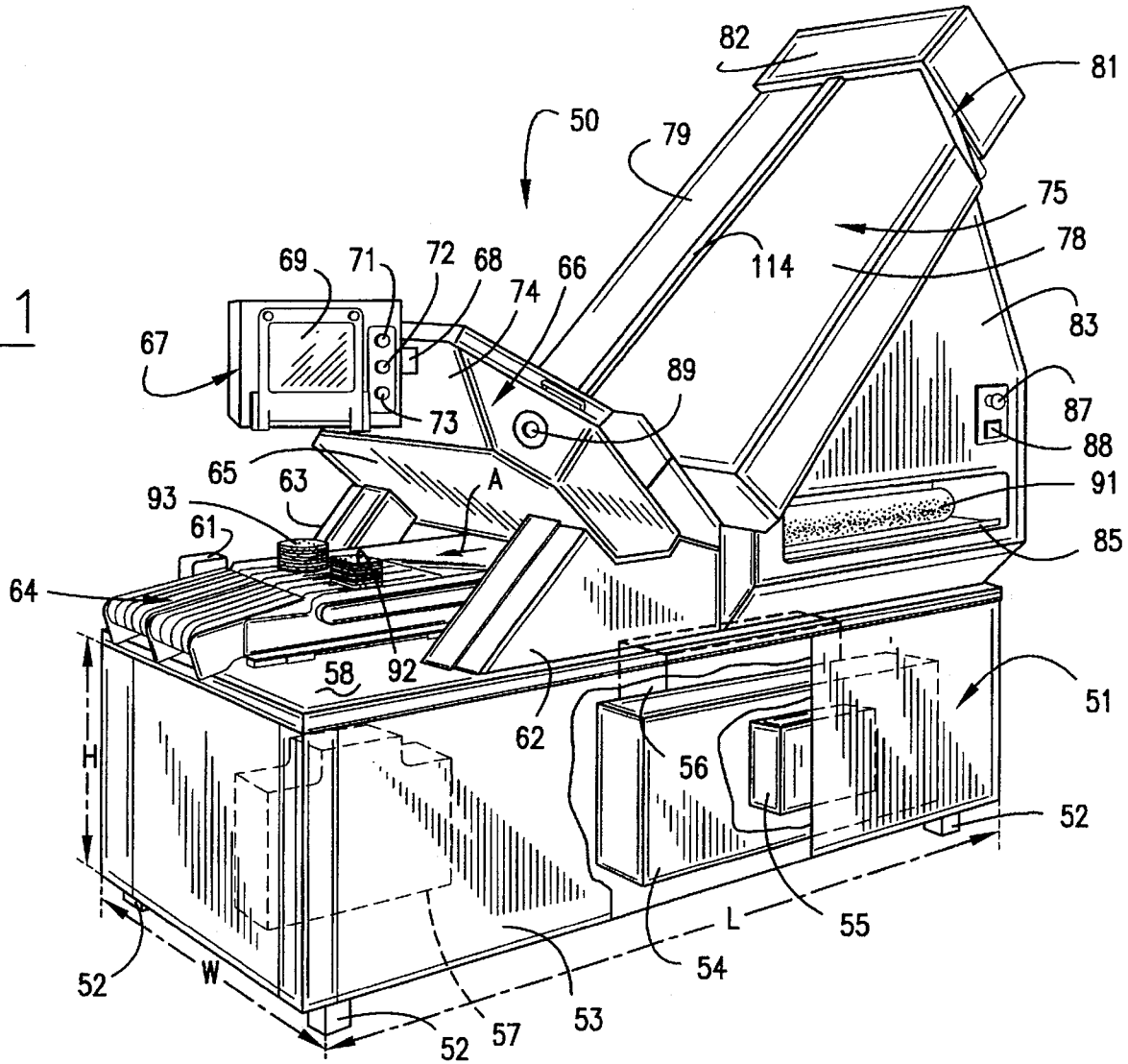
FIG. 1 is a perspective view of a slicing machine comprising a preferred embodiment of the invention, with portions of the covers on the machine base cut away to show typical power supply and computer enclosures.

FIG. 1 illustrates a food loaf slicing machine 50 constructed in accordance with a preferred embodiment of the present invention. Slicing machine 50 comprises a base 51 which, in a typical machine, may have an overall height H of approximately 32 inches (81 cm), an overall length L of about 103 inches (262 cm), and a width W of approximately 41 inches (104 cm). Base 51 is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also include a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45° and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing head 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71–73 and display/touch screen 69 are electrically connected to computer 54 in base 51.

The upper right-hand portion of slicing machine 50, as seen in FIG. 1, comprises a loaf feed mechanism 75 which, in machine 50, includes a manual feed from the right-hand (far) side of the machine and an automated feed from the left-hand (near) side of the machine. Loaf feed mechanism 75 has an enclosure that includes a far-side manual loaf loading door 79 and a near-side automatic loaf loading door 78. Slicing machine 50 is equipped for automated loading of loaves from the near-side, as seen in FIG. 1, and manual loading of food loaves on the far-side of the machine. It will be understood that automated loaf loading may be provided on either or both sides of the machine; the same holds true for manual loaf loading. Indeed, different versions of slicing machine 50 may have automated loaf loading from the near-side and manual loading on the far-side, as shown herein, or can be reversed as regards the sides using manual and automated loading. Other versions of slicing machine 50 may have automated loaf loading or manual loaf loading on both sides of the slicing machine.

Slicing machine 50, FIG. 1, further includes a pivotable upper back frame 81 and an upper back housing 82. Back frame 81 supports the upper ends of many of the components of loaf feed mechanism 75. A loaf feed guard 83 protects the nearside of the loaf feed mechanism 75 and shields mechanism 75 from a machine operator. There may be a similar guard on the opposite side of the machine. Behind loaf feed guard 83 there is a loaf lift tray 85 employed to load a food loaf into mechanism 75 during an automated loaf loading operation in machine 50 as described in detail below. A fixed loaf storage tray, used for manual loaf loading, is located on the opposite side of machine 50 but is not visible in FIG. 1.

There are some additional switches seen in FIG. 1. An emergency stop switch 87 for interrupting all operations of slicing machine 50 is mounted on the near side of loaf feed guard 83. There may be a similar emergency stop switch on the opposite side of the machine. A loaf lift switch 88 for initiating automated loading of a loaf from tray 85 into mechanism 75 is located immediately below switch 87. There would be a like switch on the opposite side of slicing machine 50 if that side of the machine were equipped for automated loaf loading. An emergency stop switch 89 is mounted on slicing station 66 on the near-side of machine 50, and there is a similar switch (not shown) on the opposite side of the slicing station. Switches 87, 88, and 89, and any counterparts on the opposite (far) side of slicing machine 50, are all electrically connected to the controls in enclosure 54.

As shown in FIG. 1, slicing machine 50 is ready for operation. There is a food loaf 91 on tray 85, waiting to be loaded into loaf feed mechanism 75 on the near-side of machine 50. Two, three, or even four food loaves may be stored on tray 85, depending on the loaf size. A similar food loaf or loaves may be stored on a corresponding loaf lift tray on the opposite side of machine 50. Machine 50 produces a series of stacks 92 of food loaf slices that are fed outwardly of the machine, in the direction of the arrow A, by conveyor classifier system 64. Machine 50 also produces a series of stacks 93 of food loaf slices that also move outwardly of the machine on its output conveyor system 64 in the direction of arrow A. Stack 92 is shown as comprising slices from a rectangular loaf, and stack 93 is made up of slices from a round loaf. Usually, both of the slice stacks 92 and 93 would be either round or rectangular. Stacks 92 and 93 may have different heights, or slice counts, and hence different weights; as shown they contain the same number of food loaf slices in each stack, but that condition can be changed. Both groups of slices can be overlapping, "shingled" groups of slices instead of having the illustrated stacked configuration. Groups 92 and 93 must be the same in one respect; both must be stacks or shingle groups. Three or more loaves can be sliced simultaneously; slicing of two loaves is more common.

Figure 2:
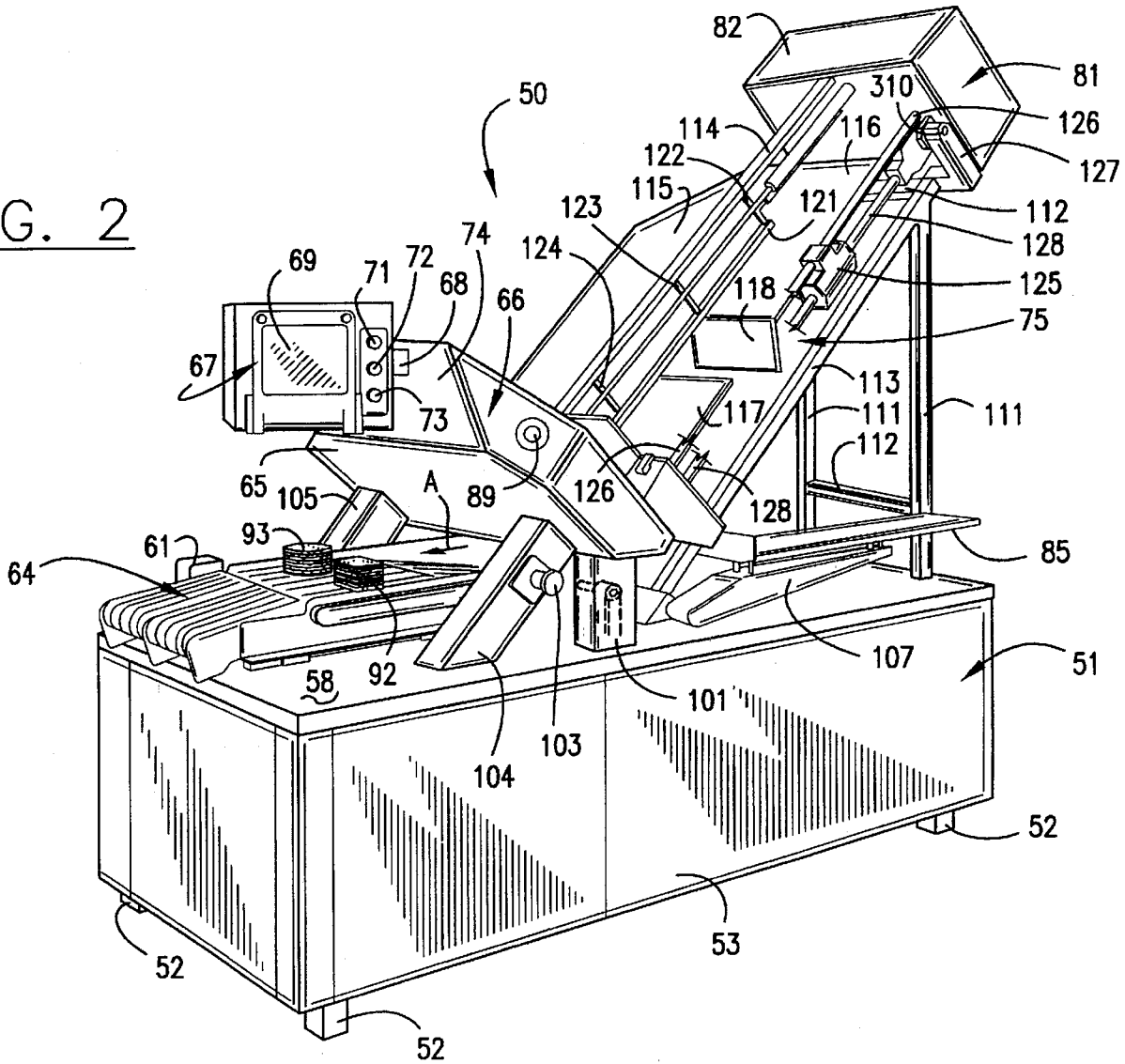
FIG. 2 is a perspective view, like FIG. 1, with some guards and covers for the loaf feed mechanism removed and some operating components of the loaf feed mechanism shown in simplified form.

FIG. 2 illustrates the slicing machine 50 of FIG. 1 with a number of the covers omitted to reveal operating components of the automated loaf feed mechanism 75 on the near-side of the machine. As shown in FIG. 2, there is a stack/shingle conveyor drive 101 located on the near-side of slicing machine 50. One part of the drive for slicing station 66 is enclosed within a support enclosure 104 on the near-side of machine 50. A manual slicing station rotation knob 103 is mounted on and projects into enclosure 104 for mechanical connection to the slicing station drive. At the opposite side of slicing machine 50 there is an enclosure 105 for a knife drive. Slicing station drive enclosure 104 and knife drive enclosure 105 extend upwardly from table top 58 at an angle, preferably approximately 45°, corresponding to the angular alignment of mechanism 75. There is a manual knife rotation knob (not shown) on the far-side of machine 50, corresponding to knob 103.

A loaf tray pivot mechanism 107 is located above top 58 of base 51 on the near-side of slicing machine 50. Mechanism 107 is connected to and operates the automatic loaf lift tray 85, as described below. A similar loaf tray pivot mechanism may be provided on the opposite side of slicing machine 50 in a machine equipped for automated loaf loading from both sides.

Slicing machine 50 includes a fixed frame pivotally supporting the automated feed mechanism 75 for feeding food loaves into slicing head 66. In the construction shown in FIG. 2, this fixed frame includes a pair of vertical frame members 111 affixed to base 51 and interconnected by two horizontal frame members 112 and joined to two angle frame members 113 (only one shows in FIG. 2). Frame members 111–113 are all located above the top 58 of machine base 51. The frame for loaf feed mechanism 75 in slicing machine 50 also includes a frame member 114 that extends from the upper back frame 81 downwardly, parallel to frame members 113, toward slicing head 66. The upper back frame 81 is mounted on pivot pins between the upper ends of two fixed frame members 127; only one member 127 appears in FIG. 2. All of the operating elements of the automated food loaf feed mechanism (see FIG. 5) are mounted on the back frame and are pivotally movable (through a small angle) relative to the fixed frame 111–113.

A manual feed tray 115 is shown at the far-side of slicing machine 50 as illustrated in FIG. 2. A similar manual feed tray may be located at the near-side of the machine in a slicing machine using manual feed from both sides of the machine.

The principal support for one or more food loaves in mechanism 75, whether food loaf loading is being carried out on an automated basis or on a manual feed basis, includes three support components, two of which are preferably of unitary one-piece construction. At the top of slicing machine 50, as seen in FIG. 2, there is an upper loaf support tray 116 that has its upper surface aligned with the top surface of a lower loaf support tray 117. Supports 116 and 117 are preferably one piece, being joined by side members omitted in FIG. 2 to avoid overcrowding. The gap between loaf supports 116 and 117 is normally filled by a loaf end discharge door 118; thus, members 116–118 normally afford a continuous loaf support surface that is the bottom for the two loaf paths in slicing machine 50. In FIG. 2, however, door 118 is shown in its open discharge position. Door 118 is hinged at the lower edge of loaf support 116 and can be elevated to provide a direct, uninterrupted surface for support of a loaf throughout mechanism 75 during most of the slicing operations carried out by machine 50. A textured upper surface is preferred for support members 116–118 to improve sliding movement of a food loaf along those support members toward slicing station 66.

The loaf feed mechanism 75 of slicing machine 50, FIG. 2, further includes a central barrier or divider 121. In the position for barrier 121 shown in FIG. 2, barrier 121 is used to position two food loaves on supports 116–118. This central barrier/divider 121 is suspended from frame member 114 by a plurality of pivotal supports 122, 123 and 124. During operation of slicing machine 50 divider 121 is elevated from the position shown in FIG. 2 (see FIGS. 7A,7B) to permit loading of one or more food loaves onto the supports 116–118. Barrier 121 is also elevated during loaf slicing so that it will not interfere with other components of mechanism 75.

The part of food loaf feed mechanism 75 shown in FIG. 2 also includes a carriage 125 that is mounted upon a rotatable shaft 126 and a stationary shaft 128 that extend parallel to the loaf support 116–118 throughout the length of food loaf feed mechanism 75. That is, carriage 125 moves along shafts 126 and 128 on a path approximately parallel to support members 113. There is a like carriage, carriage shafts, and carriage drive on the far-side of slicing machine 50.

Figure 3:
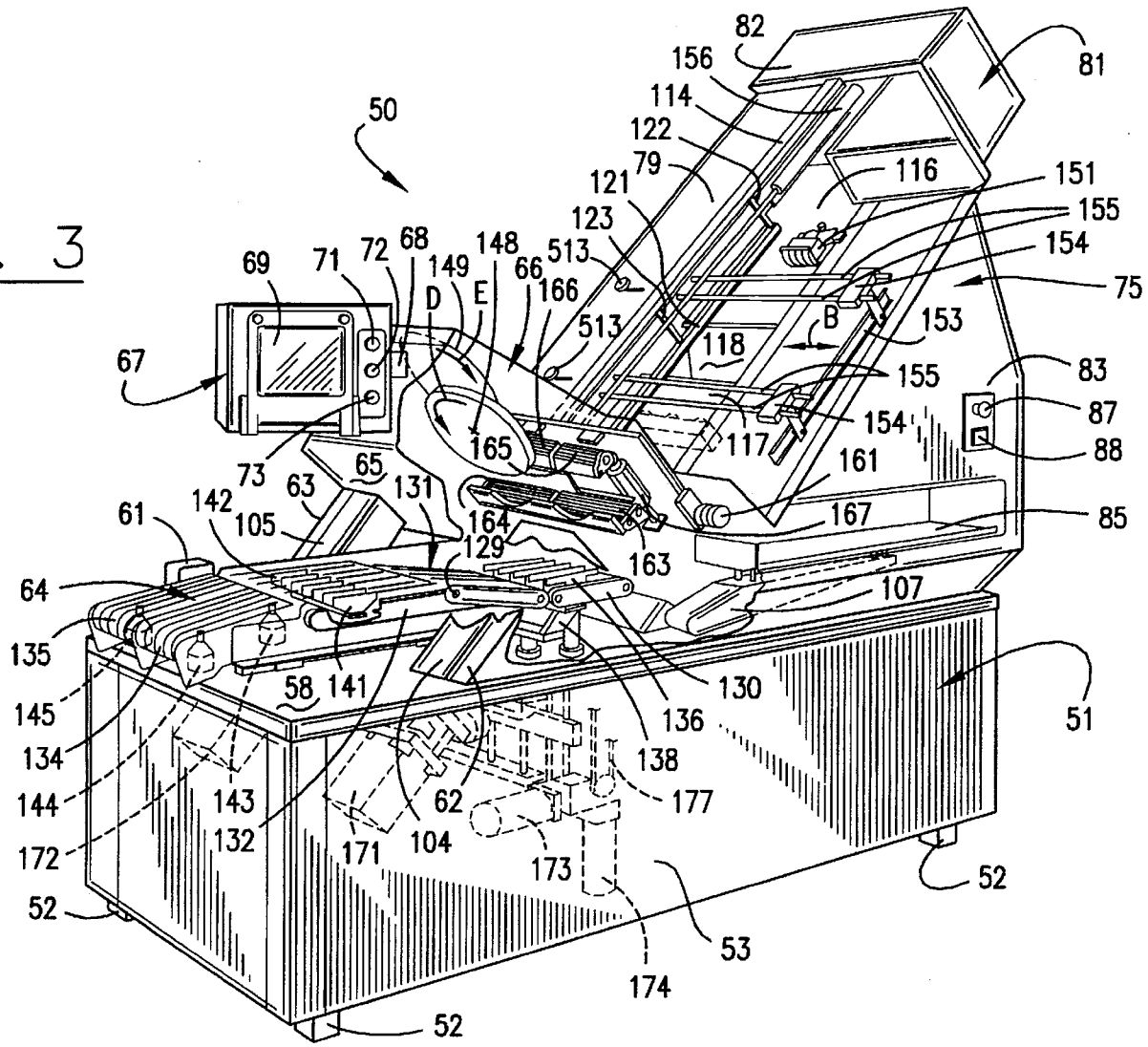
FIG. 3 is a perspective view, like FIGS. 1 and 2, with other guards and covers cut away to show further operating components of the slicing machine, some illustrated in simplified form.

FIG. 3 illustrates the same slicing machine 50 that is shown in FIGS. 1 and 2 in a conceptual view showing additional components for loaf feed mechanism 75 and other parts of the slicing machine. Thus, FIG. 3 also illustrates the general arrangement of operating components within slicing head 66, one construction that may be used for conveyor/classifier system 64, and the drive motors for parts of slicing machine 50.

Referring first to conveyor/classifier system 64 at the left-hand (output) end of slicing machine 50, in FIG. 3, it is seen that system 64 includes an inner stacking or receiving conveyor 130 located immediately below slicing head 66; conveyor 130 is sometimes called a "jump" conveyor in some versions of machine 50. From conveyor 130 groups of food loaf slices, stacked or shingled, are transferred to a decelerating conveyor 131 and then to a weighing or scale conveyor 132. From the scale conveyor 132 groups of food loaf slices move on to an outer classifier conveyor 134. On the far side of slicing machine 50 the sequence is the same, but that side of system 64 ends with a second outer classifier conveyor 135 located next to conveyor 134; see FIG. 5.

Slicing machine 50, FIG. 3, may further include a vertically movable stacking grid 136 comprising a plurality of stack members joined together and interleaved one-for-one with the moving elements of the inner stack/receive conveyor 130. Stacking grid 136 can be lowered and raised by a stack lift mechanism 138, as shown in FIG. 3. Alternatively, food loaf slices may be grouped in shingled or in stacked relationship directly on the receive/stack conveyor 130, with a series of stacking pins 137 replacing grid 136 (see FIG. 4). When this alternative is employed, lift mechanism 138 is preferably connected directly to and is used for vertical positioning of conveyor 130.

Slicing machine 50 further comprises a scale or weighing grid comprising a first plurality of scale grid elements 141 and a second similar group of scale grid elements 142; each group of grid elements is interleaved one-for-one with the moving belts or like members of scale conveyor 132. Scale grids 141 and 142 are a part of scale mechanism 57 (see FIG. 1). A scale conveyor lift mechanism 143 is provided for and is mechanically connected to scale conveyor 132. There is no weighing mechanism associated with either of the two output or classifier conveyors 134 and 135. However, there is a classifier conveyor lift mechanism 144 connected to the near-side classifier conveyor 134. A similar lift device 145 is provided for the other output classifier conveyor 135. Lift devices 144 and 145 are employed to pivot conveyors 134 and 135, respectively, from their illustrated positions to elevated "reject" positions, depending on the results of the weighing operations in machine 50 ahead of conveyors 134 and 135. See also FIG. 4.

In FIG. 3, slicing station 66 is shown to include a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion while it rotates. Other slicing head constructions may be used in machine 50, so long as the cutting edge of knife blade 149 moves along a predetermined cutting path in each cycle of operation; however, the illustrated configuration is preferred.

As shown in FIG. 3, loaf feed mechanism 75 includes a near-side clamp or gripper mechanism 151. There is a similar gripper mechanism (not shown) at the far side of slicing machine 50. Gripper 151, which is connected to carriage 125 (FIG. 2), may have the construction shown in FIG. 15, or it may use the preferred construction of FIGS. 10–12.

Loaf feed mechanism 75 further comprises a near-side sweep member 153 suspended from two sweep carriages 154 which in turn are each mounted upon a pair of sweep support rods 155. Sweep mechanism 153–155 is employed on the near side of machine 50. A corresponding sweep mechanism (not shown) may be located on the far side of a slicing machine equipped for automated loaf loading from both sides. A somewhat different manual food loaf load arrangement is used in machine 50; see FIG. 14. Sweep carriages 154 are driven along rods 155 by belts, not shown in FIG. 3, as indicated by arrows B. Rods 155 are connected to a rotatable sweep actuator 156 for actuation thereby.

Slicing machine 50 is intended to accommodate food loaves of widely varying sizes; it can even be used as a bacon slicer. This makes it necessary to afford a height adjustment for the food loaves as they move from loaf feed mechanism 75 into slicing head 66. In FIG. 3, this height adjustment, described more fully hereinafter, is generally indicated at 161.

Slicing machine 50 further comprises a system of short conveyors for advancing food loaves from loaf feed mechanism 75 into slicing head 66. The short conveyor systems are actually a part of loaf feed mechanism 75. FIG. 3 shows two short lower loaf feed conveyors 163 and 164 on the near and far-sides of slicing machine 50, respectively. These short lower conveyors 163 and 164 are located immediately below two short upper feed conveyors 165 and 166, respectively. As used in describing conveyors 163–166, the term "short" refers to the length of the conveyors parallel to the food loaf paths along support 116–118, not to the conveyor lengths transverse to those paths. The upper conveyor 165 of the pair 163 and 165 is displaceable so that the displacement between conveyors 163 and 165 can be varied to accommodate food loaves of varying height. This adjustment is provided by a conveyor lift actuator 167 that urges conveyor 165 downwardly. A similar conveyor actuator is located on the far-side of machine 50 to adjust the height of the other upper short conveyor 166; the second actuator cannot be seen in FIG. 3.

Some of the drive motors for the operating mechanisms in slicing machine 50 are shown in FIG. 3. The drive motor for the head or spindle 148 in slicing station 66 is a D.C. variable speed servo motor 171 mounted in the machine base 51. A similar servo motor 172 drives the knife blade 149. The receiver lift mechanism 138 is driven by a stacker lift motor 173, again preferably a variable speed D.C. servo motor. On the near side of machine 50 the loaf feed drive mechanism comprising gripper 151 and the short loaf feed conveyors 163 and 165 is driven by a servo motor 174. A like motor 175 on the far side of machine 50 (not shown in FIG. 3) affords an independent drive for the gripper and the "short" loaf feed conveyors 164 and 166 on that side of the slicing machine; see FIG. 4.

Figure 4:
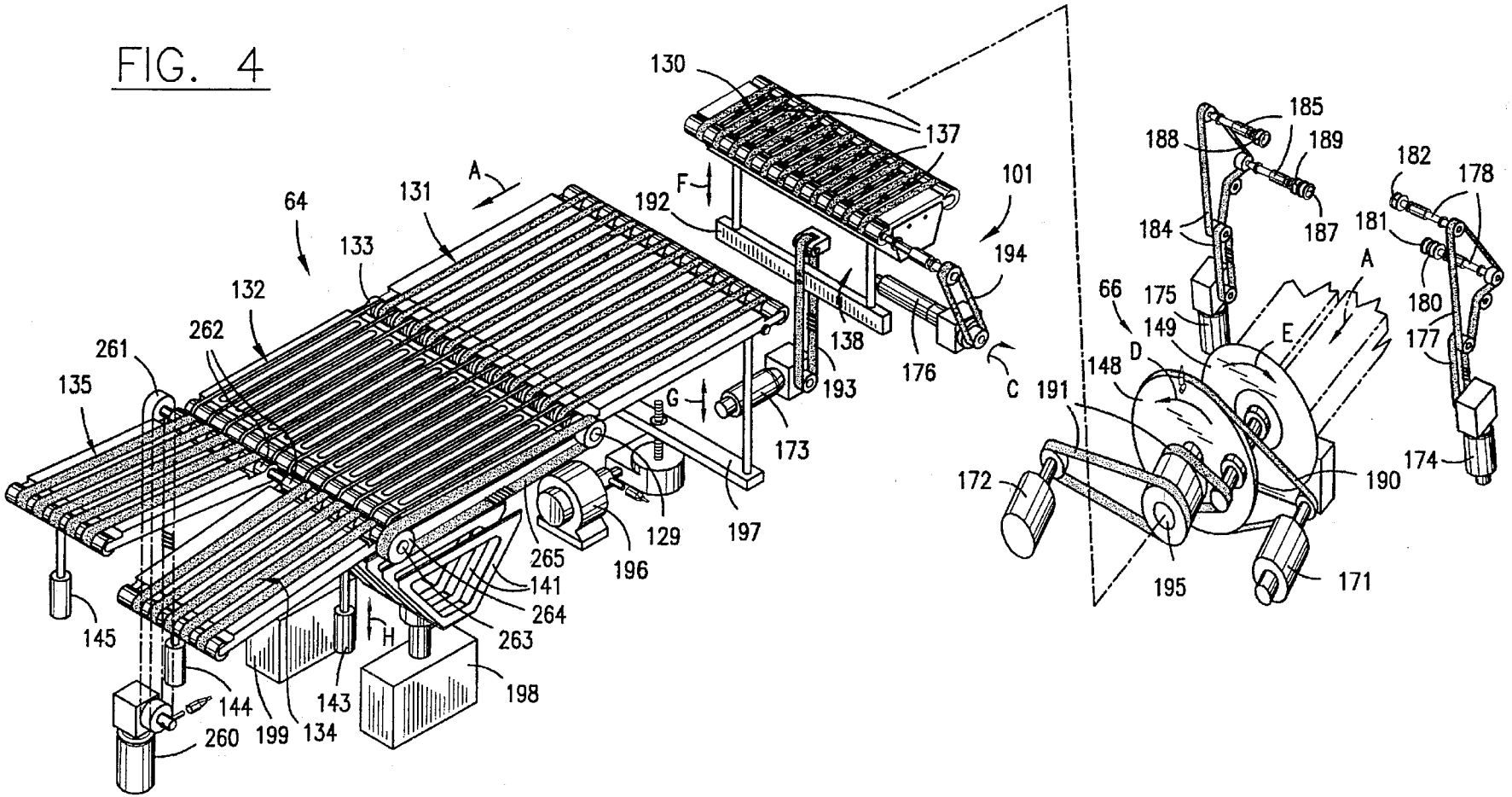
FIGS. 4 and 5 are schematic, simplified illustrations of operating components of the slicing machine of FIGS. 1–3.

FIG. 4 affords an extended, simplified illustration of the slicing, stacking or shingling, weighing, and discharge portion of the slicing machine 50 of FIGS. 1–3, along with the drives for the loaf feed mechanism. Thus, FIG. 4 provides a basis for description of many machine functions.

In FIG. 4, servo motor 174 is shown connected, as by a series of timing belts 177 and a pair of universal-joint drive connectors 178, in driving relation to feed conveyor drive pulleys 181 and 182 and to another belt drive pulley 180. Pulley 181 is the drive pulley for the near-side lower "short" loaf feed conveyor 163 (FIGS. 3 and 9); pulley 182 is the drive pulley for the near-side upper "short" loaf feed conveyor 165 (FIG. 3). Pulley 180 is the drive pulley for a gripper drive belt described hereinafter in connection with FIG. 7B. All of the loaf feed drive pulleys 180–182 have the same peripheral speed. Variation of the operating speed of servo motor 174 serves to vary the speed at which one food loaf is advanced into slicing station 66.

On the far side of FIG. 4 there is another servo motor 175 that, through a series of belts 184 and a pair of universal-joint drive connectors 185, drives the drive pulleys 187 and 188 for the far-side "short" loaf feed conveyors 164 and 166; see FIG. 3. Motor 175 also drives a drive pulley 189 for a gripper drive belt that is a part of the food loaf feed on the far-side of machine 50. The peripheral speeds for the loaf food drive pulleys 187–189 are all the same. The two servo motors 174 and 175 are adjustable in speed, independently of each other. Thus, either motor may have its speed regulated to adjust slice thickness for one loaf independently of the other.

FIG. 4 schematically illustrates the drive connection from servo motor 171 to the head or spindle 148 in slicing station 66, through a belt 190; head 148 rotates counterclockwise as indicated by arrow D. Servo motor 172, on the other hand, rotates knife blade 149 clockwise (arrow E) through a drive connection afforded by two belts 191. Orbital movement of knife blade 149 depends upon the rotational speed of servo motor 171 and the speed of rotational movement of the blade is controlled by motor 172. Each can be varied independently of the other.

FIG. 4 also shows the manner in which receiver lift motor 173 is connected to receiving conveyor 130 by lift mechanism 138; the drive connection is afforded by connection of a yoke 192 to a timing belt 193 driven by servo motor 173. Thus, motor 173 acts to lift or lower receiver conveyor 130; these actions (arrows F) are carried out cyclically for each group of slices cut from the loaves fed into slicing station 66. Conveyor 130 also requires a drive motor, shown in FIG. 4 as the servo motor 176, driving conveyor 130 through a belt 194 in drive 101. During slicing of a pair of loaves motor 176 may be inactive or may rotate slowly in the direction of arrow C (clockwise as seen in FIG. 4) while motor 173 and mechanism 138 lower conveyor 130 to obtain precise vertical stacks for each group of slices from each loaf. If shingled groups are desired, motor 176 rotates slowly counterclockwise (opposite arrow C) while the loaves are sliced. When the slice groups are complete, motor 176 drives conveyor 130 rapidly counter- clockwise to shift the group of slices, stacked or shingled as the case may be, onto deceleration conveyor 131. Thereafter, stacker motor 173 again elevates the receiver conveyor 130 rapidly to an elevated position, ready to receive two new groups of food loaf slices.

In the simplified illustration of FIG. 4, conveyors 131 and 132 share a common shaft 129, also seen in FIG. 3; a pulley 133 is mounted on shaft 129. Shaft 129 and pulley 133 are at a fixed height in the machine. The end of conveyor 131 opposite pulley 133 is adjustable upwardly and downwardly to the level necessary to receive groups of food loaf slices from conveyor 130; see arrows G in FIG. 4. The vertical movements of conveyor 131 are provided by mounting the inner end of conveyor 131 on a yoke 197 that is moved upwardly or downwardly by a motor 196. Motor 196 may comprise a pneumatic device, but a hydraulic device or an electrical motor could be used.

The outer (left-hand) end of scale conveyor 132 is dropped a short distance and subsequently elevated to the position illustrated in FIG. 4 each time a group of food loaf slices (usually two groups side-by-side) traverses the scale conveyor; see arrows H. This vertical movement of the outer end of conveyor 132 is effected by the scale lift mechanism 143. A pneumatic cylinder is preferred for lift 143; a hydraulic cylinder or an electrical linear motor could be used. When conveyor 132 moves down, the group or groups of slices on conveyor 132 are deposited momentarily on scale grids 141 and 142 and weighed (grids 142 are not shown in FIG. 4). Mechanism 143 promptly moves scale conveyor 132 back up to again carry the slice groups onward to classifier conveyors 134 and 135. Each group of food loaf slices that weighs in within a desired preset tolerance range is discharged downwardly with its classifier conveyor held down in the "accept" or "in tolerance" position shown for classifier conveyor 134 in FIG. 4. The range may be different for slice groups on the near and far-sides of scale conveyor 132. Each group of slices that does not come within the selected weight range is diverted upwardly by its classifier conveyor, held elevated in the "reject" position shown for conveyor 135 in FIG. 4. Vertical movements of the outer ends of classifier conveyors 134 and 135 are effected by linear lift mechanisms 144 and 145 for conveyors 134 and 135 respectively. Pneumatic cylinders are preferred for devices 144 and 145, but other mechanisms could be employed.

Each time scale conveyor 132 is moved downwardly (arrows H) by its lift mechanism 143, so that a group of food loaf slices on the scale conveyor is deposited on scale grid 141 on the near-side of the slicing machine, a load cell 198 weights that group of slices. It is this weighing operation that determines whether the classifier conveyor 134 is maintained in the lower "accept" position shown in FIG. 4 or is moved up to the "reject" position shown for conveyor 135 in FIG. 4. A load cell 199 performs the same basic weighing operation for each group of food loaf slices on the far-side of the machine. Thus, weight signals from load cells 198 and 199 are used to actuate cylinders 144 and 145 to elevate conveyors 134 and 135, respectively, to their "reject" alignments when food loaf slice groups are not in the preset weight ranges established for the loaves being sliced. Conversely, if a slice group weight is within the weight tolerance range, when weighed by one of the load cells 198 and 199, the applicable load cell signal is used to actuate the associated cylinder 144 or 145 to move the related classifier conveyor 134 or 135 down to its "accept" position or to maintain that classifier conveyor down in the "in tolerance" position.

Conveyors 131 and 132, and transfer conveyors 134 and 135, are preferably all driven, at sucessively slower speeds, in the direction of arrow A, FIG. 4. A conveyor drive motor 260 is connected to a timing belt 261 that drives a spindle/pulley 262 serving both classifier conveyors 134 and 135. The drive spindle pulley 262 is mounted on a shaft 263; the end of shaft 263 opposite belt 261 carries a drive pulley 264 in mesh with a timing belt 265 used to rotate shaft 129 and the spindle 133 that drives both of the conveyors 131 and 132.

Figure 5:
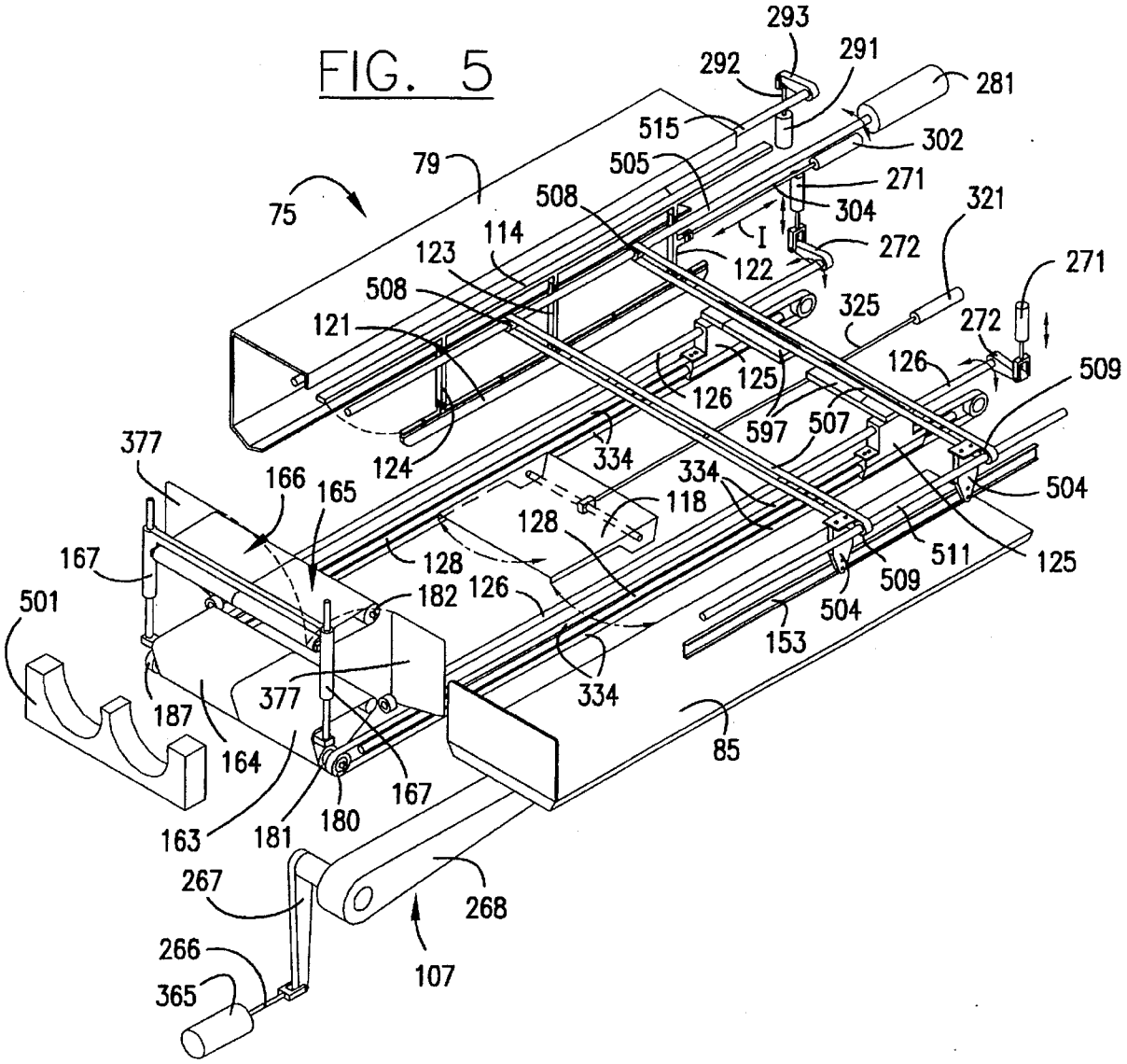

FIG. 5 affords a simplified schematic illustration of most of the loaf loading and loaf feed mechanisms in the slicing machine. Starting at the left-hand side of FIG. 5, it is seen that there is a loaf lift cylinder 365 having an actuating rod 266 connected to a crank 267 that in turn drives a loaf lift lever 268. These members 365 are a part of the loaf lift mechanism 107 that lifts storage tray 85 from its storage position (FIGS. 1–3) into alignment with the support 16–18 on which food loaves rest during slicing. The loaf lift mechanism is actuated only during loaf loading; during a loaf feeding/slicing operation, cylinder 365 is not normally actuated and keeps tray 85 in its storage position. However, tray 85 may be elevated, ready to load a new loaf or loaves into feed mechanism 75, near the end of slicing.

FIG. 5 shows the "short" conveyors 163–166, with the two upper "short" conveyors 165 and 166 mounted on the housings of cylinders 167. Cylinders 167 have fixed shafts; air applied under pressure to the cylinders tends to drive their housings, and hence conveyors 165 and 166 down toward the lower conveyors 163 and 164. Downward movement of the upper conveyors is blocked by a shear edge member 501 that is specific to the size of loaves being sliced, so that each pair of the conveyors engages opposite sides (top and bottom) of a food loaf being sliced. The drive spindles 181, 182, and 187 for conveyors 163, 165 and 164 appear in FIG. 5; their drives are shown in FIG. 4.

The drive pulley 180, shown in FIG. 4, also appears in FIG. 5. It is in meshing engagement with a near-side timing belt 334 that extends the full length of the loaf feed mechanism 75. Belt 334 is connected to the gripper carriage 125 on the near side of the slicing machine and is used to drive the carriage toward the slicing station. There is a like gripper carriage 125 driven by another long timing belt 334 on the far-side of the machine. Two parallel shafts 126 and 128 guide movements of each of the carriages 125. Shafts 128 are stationary but each of the shafts 126 can be rotated by means of a loaf door cylinder 271 and a connecting crank 272. Each carriage 125 has an extension 597 for connection to a gripper.

Returning to the left-hand side of FIG. 5, it is seen that there are two loaf doors 377, one on each side of the feed mechanism 75, immediately to the right of conveyors 163–166. The near-side loaf door 337 is mounted on shaft 126 so that it can be rotated to close off access of a food loaf into the space between conveyors 163 and 165. Similarly, the far-side loaf door 377 is mounted on the other shaft 126 and can be rotated to close off access of a food loaf into the space between conveyors 164 and 166.

FIG. 5 shows the central barrier or divider 121 that is suspended from an auxiliary frame member 114 by three pivotal hangers 122–124. The hanger 122 at the right-hand end of barrier 121, as seen in FIG. 5, is connected by a shaft 304 to an air cylinder or other linear actuator 302. Linear actuator 302 can be used to lift barrier 121, pivotally, to a point clear of any food loaves in the loaf feed mechanism, as described hereinafter.

On the near side of the slicing machine, in mechanism 75, there is an elongated sweep 153; see the lower right-hand portion of FIG. 5. Sweep 153 is suspended from two hangers/carriages 504, each connected to a drive belt 507. There are structural members, not shown in FIG. 5, that afford further support for the hanger-carriages; see FIG. 3. Belts 507 are timing belts, each engaging a drive pulley 508 and an idler pulley 509. The idlers 509 are mounted on a shaft 511. The drive pulleys 508 are affixed to a shaft 505 rotated by a loaf sweep motor 281.

FIG. 5 shows a loaf discharge door 118 that is a central part of the loaf support for the slicing machine. Door 118 is shown, in FIG. 5, in its elevated normal position, the position the door occupies when slicing is going forward. Door 118 is connected by a long rod 325 to a linear actuator 321 that opens the door to allow discharge of an unsliced butt end of a loaf, as described below.

Some of the manual loaf loading components of mechanism 75 do not appear in FIG. 5; they are masked by the manual loaf door 79 which is mounted on a shaft 515. Shaft 515 is rotated by a manual door cylinder 291 connected to the shaft by its operating rod 292 and a crank 293.

B. The Computer Flow Chart, FIGS. 6A and 6B.

Slicing machine 50 (FIGS. 1–3) is fully computer controlled. Accordingly, basic operation can be described in conjunction with a flow chart indicative of the control functions carried out by the computer program. FIGS. 6A and 6B afford the requisite flow chart; FIG. 6B follows FIG. 6A. The basic preferred driver software is TOUCH BASE driver software, licensed by Touch Base, Ltd. through Computer Dynamics of Greer, S.C.; this driver software package allows operation of the touch screen functions used in slicing machine 50. If this driver software does not load on start up there is a serious problem with computer control.

At the outset, when slicing machine 50 is first placed in operation, power to the machine is turned on, as by actuation of an appropriate input power supply switch. This input power switch is not shown in the drawings; the power supply switch may be located in or on base 51 of machine 50. Calibration of the touch screen may be required on start up; if so the operator of the slicing machine initiates calibration by actuating switches 72 and 73 (FIGS. 1–3) simultaneously. If no calibration is needed, the first step in computer control of machine 50, in the initial part of the flow chart (FIG. 6A), is an initial start 201, also effected by the machine operator. This may be accomplished with the power supply switch referred to above, or an additional switch may be interposed in the circuit to energize computer 54 through the low voltage power supply 55 and the display/touch screen 69 (FIG. 1). In the next step 202 of the flow chart, a check is made to determine if the driver software is loaded; if not, a warning reset is supplied to step 201.

Once the driver software is loaded for step 202, and screen 69 has been energized, the program recorded in computer 54 (FIG. 1) performs a sequence of initial functions, indicated by step 203 in FIG. 6A. These initial functions may include initializing interrupt of vectors, graphics driver, determination of spindle tracking hours, establishment of product codes for defaults, and a check of a battery energized backup record memory (RAM). The computer program also sets the appropriate code to match the product to be sliced by the machine, selects several action boards previously set up in the computer, makes a determination of motion control interrupt functions, establishes raw data for scale arrays related to the food loaf products and the slicing operation, and selects previously recorded graphics pertaining to a wide variety of different products so that the graphics subsequently displayed on screen 69 match the product being processed. In addition, the computer program, in the course of the initial functions step 203 (FIG. 6A), sets the maximum knife speed ratio relative to the speed of slicing head 66 required for the desired slicing operation. For any of these initial functions, some input from the machine operator may be necessary; most inputs are effected by operator touch on screen 69 (FIGS. 1–3).

At this juncture, the touch/display screen 69 has been energized; the computer program for machine 50, in step 204, FIG. 6A, sets up a title page on the screen pertaining to the slicing and grouping operation or operations to be performed by machine 50. At the same time, or immediately thereafter, the computer program operates (step 205) to start up various power systems in machine 50. These functions may include initialization of an air pressure system or a hydraulic pressure system in machine 50, or both, depending on the requirements of operating components in the machine. Pneumatic actuation is usually preferred. A motor control power circuit, included in the high voltage power supply 56 (FIG. 1), is energized so that electrical motors (mostly A.C. servos) used to perform various functions in machine 50 have power available. In step 205 the computer program also determines appropriate sample periods for weighing operations and a seam correction for the scales actuated by weighing grids 141 and 142; the sample periods may be the same if machine 50 is to produce just one product from two or more separate loaves. In step 205 the computer program also determines the average slice thickness required for each product from machine 50. Again, the slice thicknesses (and the loaf and knife speeds that determine those thicknesses) may be the same, or they may be different for loaves sliced on the near and far-sides of machine 50.

Once the computer program has completed the initializing functions of step 205, FIG. 6A, it starts an idle loop operation as indicated in step 206. This idle loop start step can go forward only if there are appropriate inputs from two flag determinations performed in steps 234 and 237 in FIG. 6B. When machine 50 has been idle, as is assumed, appropriate inputs are available from both of the two steps 234 and 237 in FIG. 6B.

At the beginning of the idle loop operation, step 206 in FIG. 6A, the program for slicing machine 50 tracks the running of calculation of a total time for the anticipated run of the slicing machine by reading start time and stop time and taking the difference; the computer also performs a plurality of other tracking functions, in step 207 (FIG. 6A). Thus, the computer records the total run time and also records the total time for power to be on, which may be somewhat longer. In step 207, the computer program may make a determination of the time period permissible before service of slicing machine 50 is required.

When these operations have been completed in step 207 the computer determines if an emergency stop check can be cleared in the next step 208. What this amounts to is a check to determine whether any of the emergency stop switches 87 and 89 have been actuated. If an emergency stop signal has been recorded, there is a "yes" output at step 209 in the program, resulting in initiation of a subsequent step 211. In step 211 the computer records a fault message, turns off all machine outputs, and stops all machine motors. If there is a "no" output at step 209, indicative of the fact that no emergency stop switch has been actuated, then a step 212 is carried out by the computer to clear any emergency stop message that may be held over from previous operations and to clear all flags from the control system.

In the next program step 213, FIG. 6A, the computer of slicing machine 50 makes a determination as to whether an emergency stop has been set. If this action has occurred, the next step 214 is the performance of a servo check by the computer and a determination of whether the drives for machine 50 are not ready for operation or if there has been a fault due to a thermal overload. In this step 214 the computer also may set a "stop now" flag. If such a flag is set, in the next step 215 the existence of that flag is identified and a further program step 216 is initiated to stop all motion in the slicing machine 50 and to carry out a normal shut down of that machine.

Returning to step 213, the computer may ascertain that no emergency stop has been set. In this circumstance, a step 217 is initiated to check whether all guards and doors have been closed on machine 50 and the motor drives for the slicing machine are ready for operation. In step 217 the computer also makes a determination of whether electrical faults have occurred as a result of vibration or other causes. If no fault is ascertained, an enabling output is produced in the next step 218 and fed back to the servo check of step 214. If a fault is found, the next program step 219 is initiated, setting a fault message, turning all outputs off, and stopping all motors in the slicing machine 50. The output from step 219 is supplied back to the servo check step 214. In FIG. 6A, it will be seen that steps 207–209 and 211–219 are all enclosed in a phantom outline 221, which is referred to again hereinafter in conjunction with a portion 248 of FIG. 6B.

The next step in the flow chart of FIG. 6A is a determination of whether a product removal flag has been set; see step 222. If such a flag has been set, a subsequent program step 223 is initiated. At this juncture, if the operator has held the load feed switch 73 (FIG. 1) actuated for a predetermined minimum period (typically five seconds) then the computer program prepares for product removal. Completion of step 223 or a determination in step 222 that no product removal flag has been set results in initiation of a further step 224, constituting a display of an emergency stop message on display screen 69 (FIG. 1), if previously set.

Following step 224, in the next step 226 of FIG. 6A the recorded program of slicing machine 50 checks to determine whether a flag has been set to preclude jogging of the conveyor system 64. If there is an affirmative output from step 226, a subsequent step 227 starts jogging movement of the conveyor system. An output from step 227 or a negative output from step 226 initiates a subsequent step 228, which is a check to determine whether a flag has been set for stopping jogging movement of the conveyor system. If no such flag has been set there is an output to the initial stage 232 of FIG. 6B. If there is an affirmative output from step 228, then an additional step 229 is carried out to stop jogging movement of the conveyor system 64 (FIG. 1).

FIG. 6B shows the steps for the remainder of the flow chart that began with FIG. 6A. At the beginning of the portion of the flow chart shown in FIG. 6B, there is a program step 232 in which the computer looks to see if there has been a start run and a fault set. If both conditions have occurred while attempting to start a run cycle, there is a yes output from step 232 to the next step 233 and a disabling cycle is initiated for slicing machine 50 by the program prerecorded in its computer. In the course of step 233, if there has been a run flag, so that running of the machine is not permissible, that flag may be cleared. Of course, the stated combination of conditions (lack of a start run or a run fault set) may not be found in step 232, in which case step 233 is by-passed. In either event, there is an enabling input to a further step 234 in the computer program, which again checks for the existence of a run flag. Actually, in step 234 the program is checking to see whether the cycle start switch 71 has been actuated by the operator. If not, there is an output to step 206 in FIG. 6A. If the operator has actuated the run/start control switch, there is an enabling output to the next step 235 in the flow chart.

In step 235 of the flow chart, FIG. 6B, the computer performs a variety of functions. To begin with, it records the time that machine 50 has been out of operation for faults and starts a number of machine subsystems in operation. Thus, in display 69 the computer program causes the display of a homing message. The knife 149 in slicing head 66 (FIG. 3) is brought to a home orientation. The clamps 151 of loaf feed system 75 (see FIG. 3) are also brought to their respective home positions. Other homing operations are performed for the conveyors of conveyor system 64. The computer checks to see if the enclosure doors for loaf feed system 75 are closed, as shown in FIG. 1. Center divider 121 (FIGS. 2 and 3) is raised to its elevated position, high enough to be clear of any loaf that may be moved onto the loaf supports (116–118) of the slicing machine. Grippers 151 are unactuated; see FIG. 12. The controls of machine 50 are set for automatic or manual loading. The loaf cover is raised, stacking conveyor 130 is elevated, and motion control for the machine is checked to see whether it has been cleared. The anticipated production start time is also recorded in step 235. When all of these operations have been completed, an output to step 236 in the flow chart is effected; machine 50 is now ready to start slicing. It is assumed that there is an appropriate input to program step 236 from the final step of the flow chart, as described below.

In the next step 237 of the program illustrated by the flow chart of FIG. 6B, the computer of machine 50 ascertains whether a flag has been set to permit running operation. This is a requirement imposed upon the machine operator. If it has not been fulfilled, there is a no output from stage 237 to step 206 in the portion of the flow chart illustrated in FIG. 6A, so that machine 50 reverts to its idle mode of operation. However, if the operator has set a run flag to indicate that machine 50 is ready for slicing and that such operation is desired, then there is an output from program step 237 to the next step 241.

It may be desirable to check for profile variations at the beginning and end of each food loaf sliced, in order to track taper of the loaf and make thickness corrections according to loaf profile trends. If profile corrections are to be made, step 241 affords a YES output to the next step 242 to make profile corrections. If there are to be no profile corrections, or if none are required, the next input is to program step 243. At this point, the touch screen 69 is checked to see if the operator has entered instructions by means of a touch; the selected screen image is displayed. In the succeeding step 244 the computer checks to see if gross weight is to be measured. If the answer is YES, a gross weight for the product is determined in step 245. When that weighing step is completed, or if no gross weight is to be determined, the flow chart goes on to a further step 246. In the next step 246 the computer ascertains whether a stop switch has been actuated or a fault has been found by the sensor switches of machine 50, such as sensor switches that determine whether all guards are in place. If, in step 246, it is determined that operation of the slicing machine 50 should not begin, then in the next step 247 all motion within the machine is interrupted and a normal shutdown is carried out. Step 247 is by-passed if there is a negative condition ascertained in step 246. After step 247, the program represented by the flow chart performs functions, in a composite step 248 that correspond in all respects to the functions described above for steps 207–209 and 211–219 in phantom outline 221 of FIG. 6A.

After the composite step 248, FIG. 6B, an input to the next step 252 in the flow chart may result in a determination that the gripper clamps 151 of machine 50 (FIG. 3) need to be retracted, or that they do not need to be retracted. If the clamps must be retracted, then program step 253 comes into play. The clamps are retracted, and the average load time and number of loaves are tracked. On the other hand, step 253 in the program may be by-passed by a negative output from step 252. In either case, there is an enabling input to program step 254, where it is ascertained whether the grippers 151 are ready to grip food loaves. If yes, the gripping operation of step 255 is initiated. If no, the next subsequent step 256 is enabled. Step 256 may also be enabled by an output from step 255. As the food loaf slice groups constituting the output of slicing machine 50 move to position to be weighed on conveyor 132, an appropriate input has been made, prior to this time, by the computer program. In step 256 of the program flow chart, a positive output results in an enabling signal to the next step 257, to cause the machine to weigh each product slice group as it leaves the machine. If the sliced product group (or groups) is not in position for weighing, there is a negative output from step 256, or an output from step 257, supplied to the run loop start step 236 to maintain the slicing machine in operation. Either way, operation continues until a given desired slicing operation is finished.

C. Loaf Feed Mechanisms, FIGS. 7–12.

FIGS. 7A, 7B, 8 and 9 illustrate many of the important features of the present invention. FIG. 7C shows how FIGS. 7A and 7B abut each other. All are concerned with the mechanism 75 used to feed two or more food loaves along parallel paths, each defined by the supports 116–118 that lead into slicing head 66. See FIGS. 1–5.

Figure 7A:
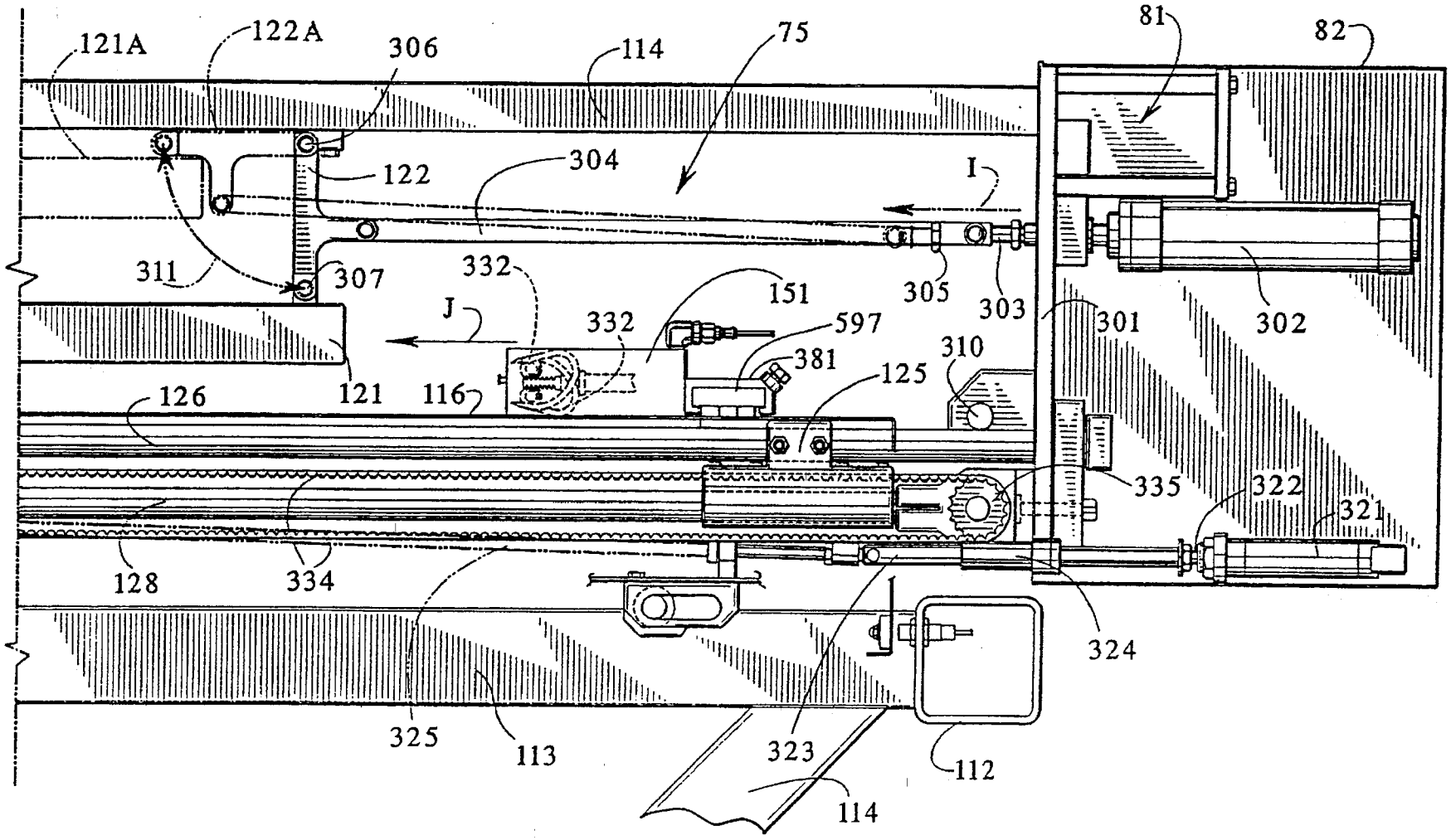
FIGS. 7A and 7B, which fit together as shown in FIG. 7C, jointly afford a longitudinal section view of principal components of the loaf feed mechanism for the slicing machine of FIGS. 1–5.

As shown in FIG. 7A, the back frame 81 comprises a transverse frame member 301 mounted for limited pivotal movement about a pair of pivots 310 (only one shown). Indeed, all of the operating components of loaf feed mechanism are pivoted for very limited movement about pivots 310. This includes auxiliary frame member 114, shafts 126 and 128, conveyors 163–166, drive belts 334, and shafts 505 and 515; see FIG. 5. As indicated in FIG. 7A, actuator 302, which may be a pneumatic, hydraulic or electrical linear actuator, is mounted on frame member 301. A pneumatic actuator is preferred. The operating rod 303 of actuator 302 is connected to one end of drive rod 304 by a connector 305. The direction of movement of rods 303 and 304 is indicated by an arrow I. The other end of drive rod 304 is connected to the leg of the first pivotal barrier support member 122. Support member 122 is generally T-shaped, rotated 90° so that the leg of the T is horizontal and the bar of the T is vertical. One end of the bar portion of support 122 is pivotally connected to frame member 114 at a pivot 306. The other end of the bar of support 122 is pivotally connected to barrier 121 at a pivot 307.

Figures 7A, 7B, 7C:
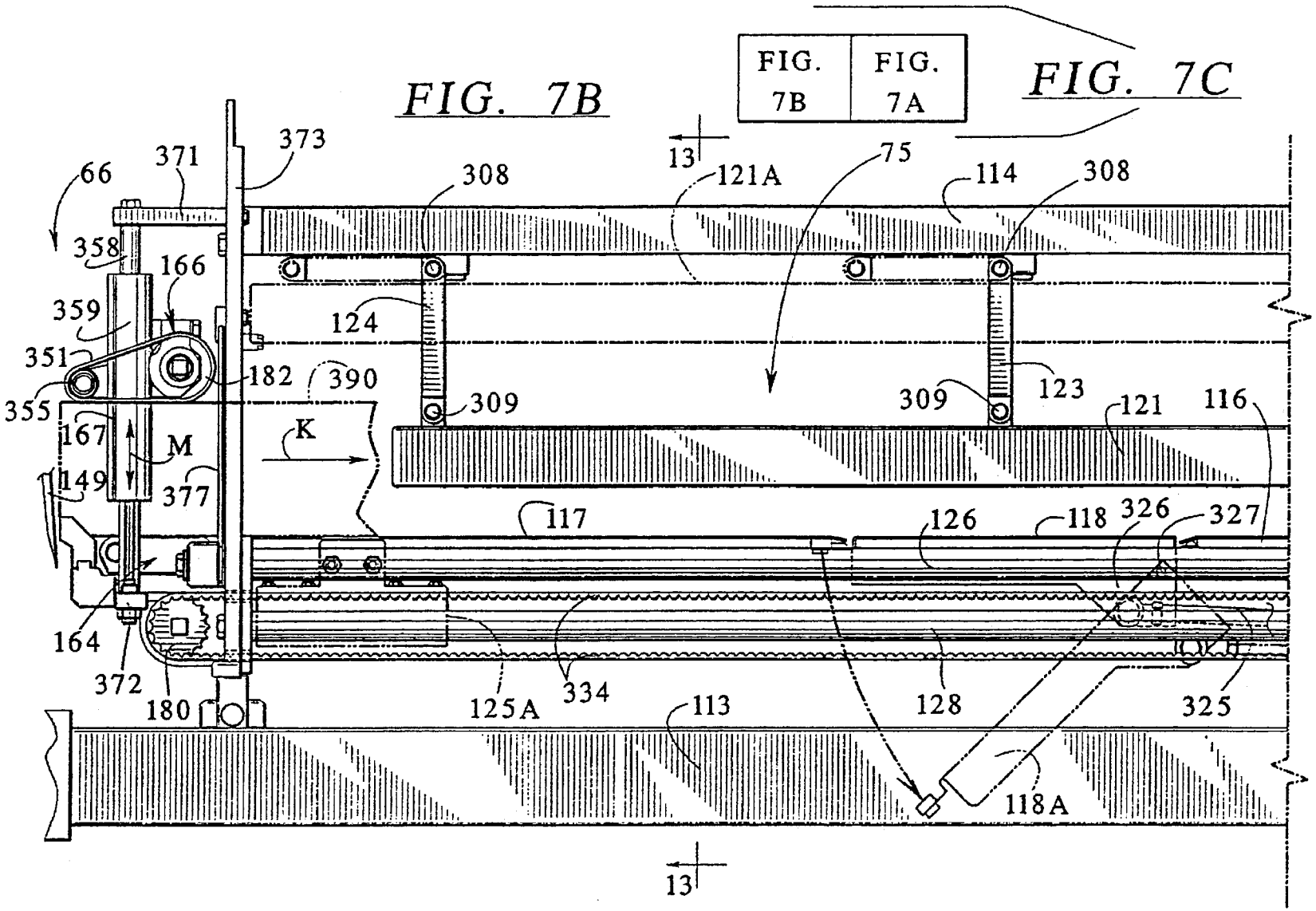

The remaining supports 123 and 124 for barrier 121 are shown in FIG. 7B. Each is a simple linear vertical support bar, pivotally connected to a fixed point on frame member 114 at a pivot 308 and connected to barrier 121 at a pivot 309.

The divider 121, which is preferably generally V-shaped in cross section (see FIGS. 13 and 14), constitutes an elongated barrier located at the center of the loaf feed mechanism 75 between the first and second loaf paths of the slicing machine. In FIGS. 7A and 7B barrier 121 is shown in solid lines in a first operating position, in which the barrier is engageable with the adjacent inner surfaces of two feed loaves (not shown). When a new loaf is fed into mechanism 75, whether manually or automatically, barrier 121 is displaced to a second operating position 121A clear of any food loaves on the food loaf paths. Barrier 121 is also held elevated in its second operating position 121A while food loaves are sliced. Displacement of barrier 121 between its first and second operating positions is effected by the barrier displacement means 302–305.

Thus, before a new food loaf is loaded into loaf feed mechanism 75, from either side of slicing machine 50, linear actuator 302 has been energized and has driven the piston rod-connector rod assembly 303–305 in the direction of arrow I, FIGS. 7A and 7B. This movement of connector rod 304 rotates barrier support member 122 clockwise along path 311, as seen in FIG. 7A, to the position indicated by phantom outline 122A, moving barrier 121 to its elevated second operating position 121A. Because barrier 121 is connected in a parallelogram structure with pivotal supports 123 and 124, the complete barrier is moved up to its second operating position, shown by phantom outlines 121A in FIGS. 7A and 7B.

After a new loaf or new loaves (not shown) have been transferred into mechanism 75, linear motor 302 is de-energized, assuming a spring-return linear actuator is employed. If there is no spring return or the like in actuator 302, reverse energization may be used. In either event, the piston rod/connection rod assembly 303–305 is pulled back, opposite to arrow I, FIG. 7A, and barrier 121 is pulled down to the first operating position shown in solid lines in FIGS. 7A and 7B. A positive return drive is preferred, so that on its return (downward) movement barrier 121 is forced between the loaves in mechanism 75 to align them accurately on the parallel food paths on supports 116–118, the food paths ending at slicing head 66. Linear actuator 302 is again energized to shift barrier 121 back to its alternate position 121A after the loaves have been engaged by grippers 151 (as described below) so that the barrier does not interfere with air and/or other lines connected to the grippers.

The loaf feed mechanism, FIGS. 7A and 7B, includes two rotatable shafts 126; only one shaft 126 appears in FIGS. 7A and 7B. The two rotatable shafts 126, one on each side of the slicing machine, are generally parallel to the main frame members 113. However, these shafts, and the other components of the loaf feed mechanism in machine 50, are movable through a small range, relative to slicing head 66, to accommodate variations in loaf size. Two additional, non-rotatable shafts 128 are included in the loaf feed mechanism 75, parallel to shafts 126. Only one shaft 126, one shaft 128, and one main frame member 113 appear in FIGS. 7A and 7B. The loaf supports 116 and 117, which are parallel to shafts 126 and 128, remain in place at all times when the slicing machine is ready for operation or in operation. During cleanup of machine 50, they are dropped to afford access to portions of the loaf feed mechanisms. Door 118, which closes the gap between trays 116 and 117, serves a more active purpose.

The door actuator 321, which may be a pneumatic, hydraulic, or electrical linear actuator, is mounted on member 301 within the housing 82 of back frame 81, FIG. 7A. A pneumatic actuator 321 is preferred. The operating rod 322 of door actuator 321 is connected to one end of a link 323 that projects through a sleeve 324 in frame member 301; the other end of link 323 is pivotally connected to one end of a connector rod 325. The other end of rod 325 is pivotally connected to a depending portion 326 of door 118; see FIG. 7B. Door 118 is pivotally mounted on a horizontal shaft 327 that extends across loaf feed mechanism 75.

Door 118 has two operational positions. In its elevated or closed position, shown in solid lines in FIG. 7B, the upper surface of door 118 is flush with and constitutes a substantially continuous bridge between the upper surfaces of loaf trays 116 and 117. That elevated position is usually occupied by door 118 while food loaves are fed along the loaf paths, of which door 118 is a part, leading into slicing head 66 (FIGS. 1–3 and 5). But when slicing nears completion, actuator 321 (FIG. 7A) is energized to pull its piston 322 and rods 323 and 325 to the right, as seen in both of FIGS. 7A and 7B. This movement pivots door 118 counterclockwise, as seen in FIG. 7B, to its alternate open position 118A. Consequently, when a gripper 151 clamped on the end of a loaf is moving back to its home position, the position shown in FIG. 7A, the gripper can be actuated to release the loaf butt as it passes over the gap in the loaf paths created by dropping door 118 to its open position 118A, FIG. 7B. Door 118 is preferably closed, as by de-energizing or reverse energizing linear actuator 321, before new food loaves are deposited on supports 116 and 117.

From the previous description, it will be recognized that slicing machine 50 provides loaf feed means for advancing food loaves along each of the two loaf paths based on supports 116–118. There are independent drives or feed means for each of the loaf paths. One such feed means and its associated drive are shown in FIGS. 7A and 7B, with some components shown in greater detail in FIGS. 8 and 9. These mechanisms are duplicated for the other, parallel food path; see FIG. 5.

Starting with FIG. 7A, it is seen that gripper 151 is mounted on an extension 597 of carriage 125 by a bracket 381; carriage 125 engages and slides longitudinally along the rotatable shaft 126 and the parallel fixed shaft 128. One preferred construction for a gripper is described in detail below in connection with FIGS. 10–12; another gripper construction is described in regard to FIG. 15. To understand basic operation of gripper 151, at this juncture it is sufficient to note that each gripper has a plurality of tines 332 that can be actuated to penetrate and grip one end of a feed loaf supported on members 116–118. Tines 332 can also be released from gripping engagement with the end of the loaf when desired. In FIG. 7A gripper 151 is shown at its home position, ready for use, with its tines 332 retracted.

Carriage 125 is connected to the upper run of a timing belt 334 that extends for the full length of loaf transfer mechanism 75. Timing belt 334 engages an idler sprocket 335 at the right-hand end of the transfer mechanism 75 (FIG. 7A); the timing belt engages a drive sprocket 180 at the other end of the belt (FIG. 7B) adjacent slicing station 66 and its orbiting blade 149.

Figure 8:
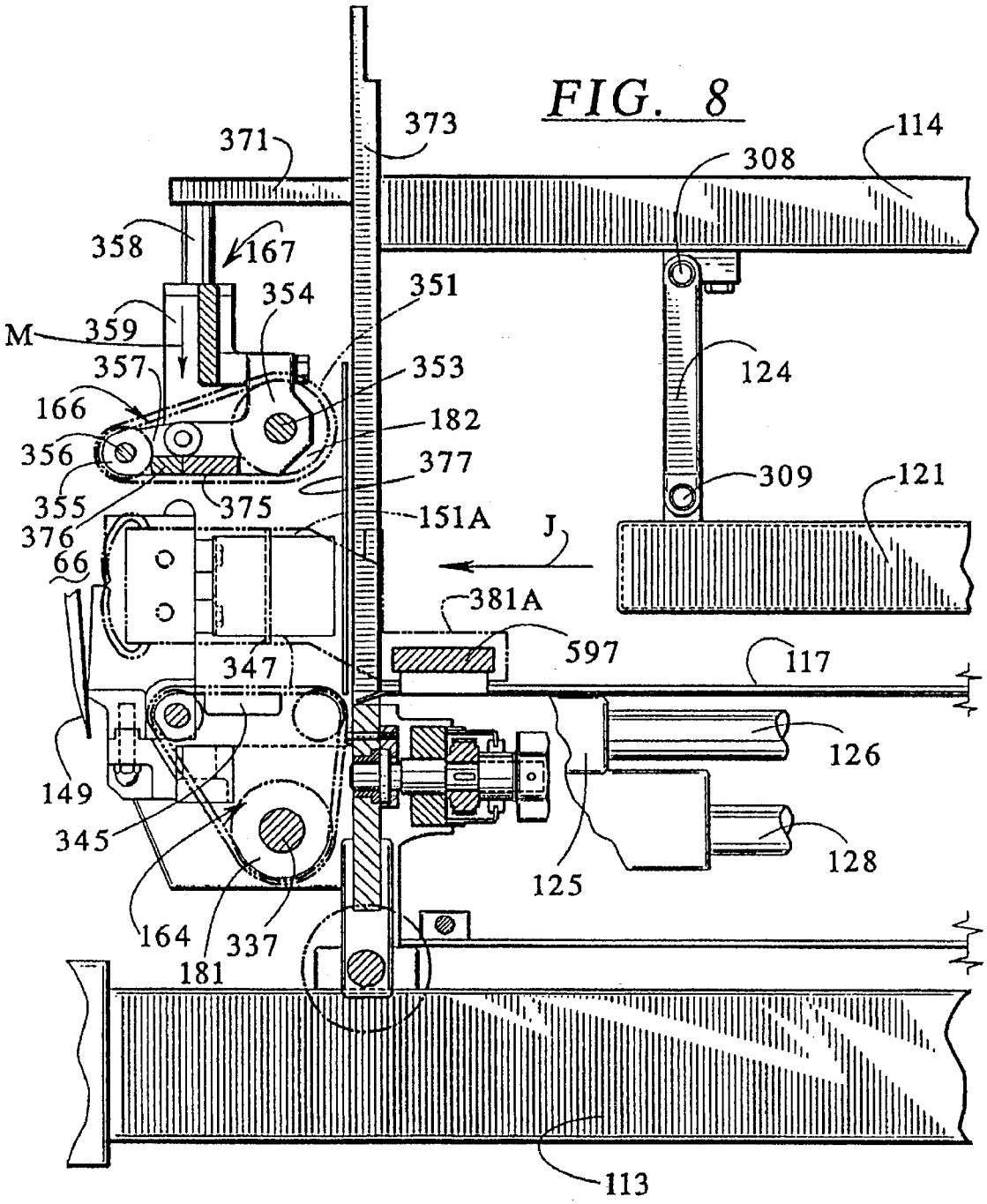
FIG. 8 is a detail section view, similar to FIG. 7B, of a portion of the loaf feed mechanism that feeds loaves into the slicing station of the machine of FIGS. 1–5.
Figure 9:
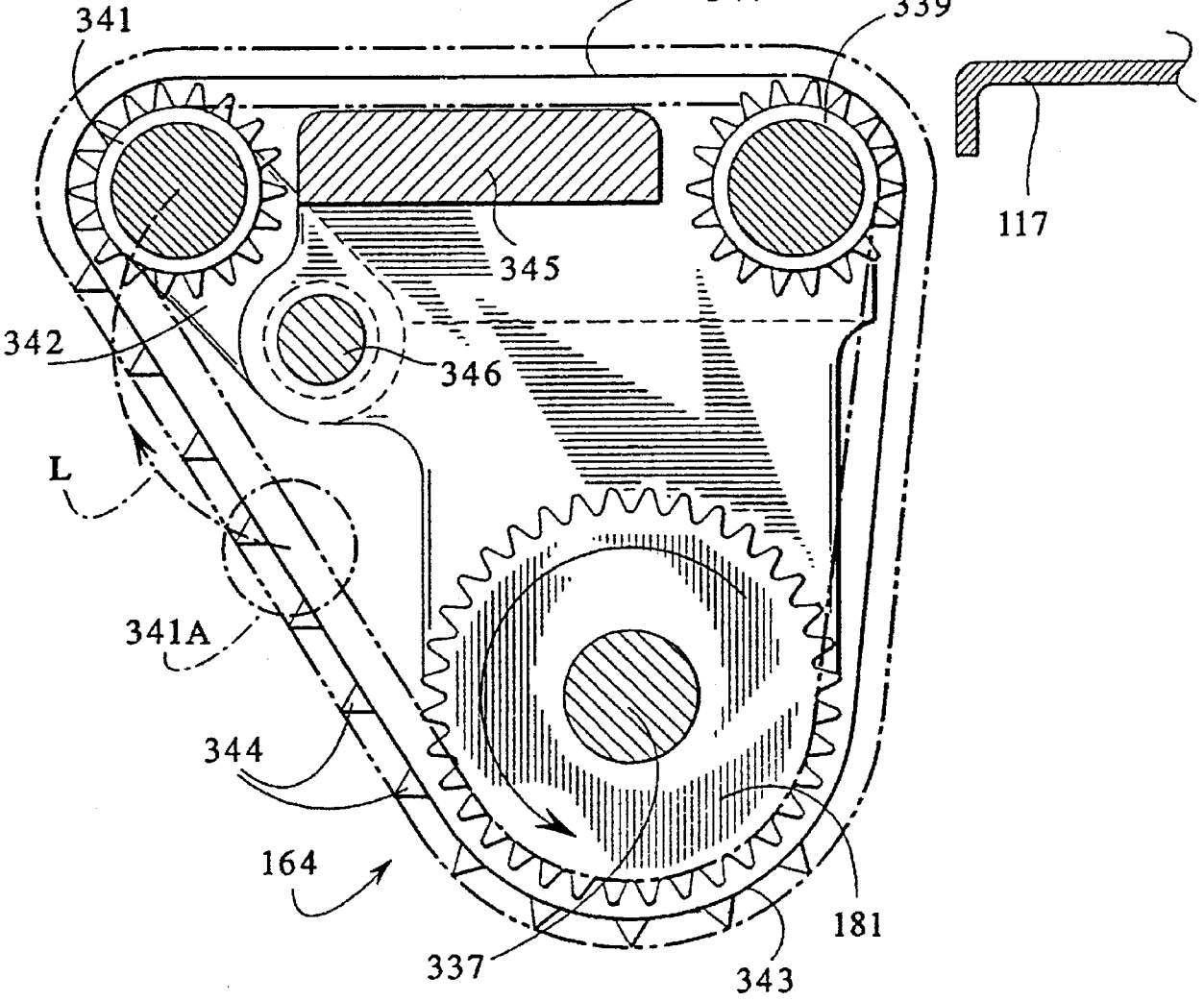
FIG. 9 is a detail section view, on an enlarged scale, of a lower "short" conveyor used in the slicing machine of FIGS. 1–5.

In addition to gripper 151, each loaf feed means in machine 50 includes two short conveyors, exemplified by conveyors 164 and 166 in FIGS. 7B and 8. The lowermost "short" conveyor 164, which is shown in detail section on an enlarged scale in FIG. 9, includes the drive pulley 181 mounted on a drive shaft 337, a first idler 339, and a second idler 342 mounted on a pair of levers 342 (only one shown) affixed to a shaft 346. A wide conveyor belt 343 is entrained around pulleys 181, 339, and 341. Belt 343 is mounted on conveyor 164 with idler pulley 341 in the position 341A. Levers 342 are pivoted clockwise, as indicated by arrow L in FIG. 9, to place belt 343 in tension. Belt 343 may have outwardly projecting "ridges" 344, as shown in FIG. 9, for positive engagement with a food loaf. A support bar 345 is positioned immediately below and supports the upper run 347 of belt 343 to maintain and support upper belt run 347 parallel to and aligned with the top surface of loaf support member 117 (FIGS. 7B, 8 and 9).

The other, uppermost, "short" conveyor 166 is similar to but even simpler than the lower conveyor 164. As shown in FIG. 8, the upper "short" conveyor 166 comprises a conveyor belt 351 extending around and engaging the drive pulley 182, which is shown mounted on a shaft 353 (FIG. 8). Shaft 353 is journalled in two support members 354; only one is shown. An elongated idler pulley 355 is rotatably mounted on a shaft 356 that is supported on two levers 357 (only one shown) pivoted on support members 354. Pivotal movement of pulley 355, made possible by its mounting on levers 357, tensions belt 351. The entire "short" conveyor 166 is mounted on the housing 359 of the pneumatic, hydraulic, or electrical linear actuator 167; a pneumatic actuator, continuously energized for downward movement, is used in a preferred construction for the slicing machine. Housing 359 is driven down on its piston or shaft 358 as indicated by arrow M in FIG. 7B. The opposite ends of shaft 358 are affixed to and supported between a pair of frame members 371 and 372 that extend outwardly from a vertical frame member 373 that is positioned between loaf feed mechanism 75 and slicing station 66; see FIGS. 7B and 8. The upper "short" conveyor 166 includes a two-piece support bar 375, 376 to keep the lower run of conveyor belt 351 flat; see FIG. 8.

Before food loaves are positioned on the two loaf paths defined by members 116–118 (the food loaves are loaded simultaneously) center barrier 121 is elevated to its feed position 121A, FIGS. 7A and 7B, by energizing barrier actuator 302, FIG. 7A. The new food loaves are moved toward the longitudinal center of transfer mechanism 75, where barrier 121 is located, until they contact another loaf guide as described hereinafter. Barrier actuator 302 is then retracted (de-energization may do the job if device 302 has a strong spring return) and barrier 121 moves downwardly to its lower operating position. Barrier 121 is preferably one inch (2.54 cm) wide at maximum; it aligns the two food loaves approximately parallel to each other on their respective food paths, separated from each other by approximately one inch (2.54 cm). This separation is arbitrary, determined by the width of divider 121. The separation required is determined by the spacing between grippers 151 in machine 50.

When a food loaf is first placed on support members 116–118 it may tend to slide down toward slicing station 66; the support members of transfer mechanism 75 are at an angle of 45° as shown in FIGS. 1–3. The upper surfaces of the support members preferably have a textured finish to facilitate sliding of the food loaf. Each loaf path is closed off, near the slicing station 66, by a door or gate 377 (FIGS. 7B and 8) mounted immediately adjacent frame member 373. Thus, a loaf entering mechanism 75 cannot slide down unexpectedly and prematurely into slicing station 66.

Once a food loaf is positioned on its path, gripper 151 is advanced from its home position (FIG. 7A) in the direction of arrow J (FIG. 7A) until it engages the end of the loaf farthest from slicing head 66. This is done by driving belt 334 to move the gripper carriage 125 in the direction of arrow J (FIG. 7A) until the gripper is blocked by engagement with the end of the food loaf. Where engagement of gripper to loaf occurs is dependent upon the length of the loaf. Food loaves may vary considerably in length, typically two to four feet (61 cm to 102 cm). Machine 50 can accommodate a food loaf of any length from as short as one foot (25 cm) to as long as four feet (102 cm).

When gripper 151 contacts the end of a new loaf, the gripper is energized to actuate its tines 332 to penetrate and clamp onto the loaf end, as described hereinafter. At this juncture belt 334 moves the gripper carriage back a short distance (e.g. on ¼ inch or 0.6 cm); the loaf moves with the gripper. Door 377 (FIGS. 7B and 8) of slicing head 66 can now be opened, since the loaf no longer engages the door. The drive for timing belt 334 is again reversed and again advances gripper carriage 125 and gripper 151 in the direction of arrow J, FIG. 7A. Actuator 167 is continuously energized toward movement in a downward direction, engaging the top of a shear edge member 501 (FIGS. 5 and 8). The short feed conveyor 166 is thus engaged with the top of the loaf; see the phantom loaf outline 390, FIG. 7B. Thus, the two short feed conveyors 166 and 164 engage the top and bottom, respectively, of the end of the loaf moving into the slicing station, toward blade 149; see FIG. 7B and FIG. 8. Both short loaf feed conveyors 164 and 166 are driven at the same speed as timing belt 334, as noted in the description of FIG. 4; the loaf feed conveyor drive pulleys 181 and 182 are the same size as the drive pulley 180 for belt 334. Other techniques to make sure that feed conveyors 164 and 166 operate at the same speed as belt 334 may be used as desired. The speed of conveyor belts 347 and 351 (FIG. 8) and timing drive belt 334 (FIG. 7B) is a principal determinant for the thickness of slices cut from each food loaf by blade 149. The orbital speed of blade 149 is the other principal determining factor for slice thickness. The gripper/loaf speed, selected by the operator and/or by the machine's computer program in conjunction with knife blade orbital speed, determines the weight of the individual slices cut from each food loaf. During slicing, the orbital speed of the knife is preferably kept constant, so that variations of the gripper/loaf speed (belt 334) determine slice thickness and weight.

With continued slicing gripper 151 moves toward slicing station 66, ultimately reaching the end position 151A of FIG. 8 with the gripper carriage in its end position 125A, FIG. 7B. This end position is selected to coincide closely with the end of effective slicing size for the food loaf. The thin remaining butt end of the food loaf usually should not be sliced; it is likely to yield undersized slices.

When gripper 151 reaches its end position 151A, FIG. 8, it is tracked by an encoder (not shown) on servomotor 174, which causes the machine's computer program to stop movement of the loaf toward the slicing station, arrow J in FIGS. 7A and 8. The drive for timing belt 334 (and for conveyors 164 and 166) is reversed; gripper carriage 125 and gripper 151 start back toward their home positions shown in FIG. 7A. See arrow K in FIG. 7B. During return movement of gripper 151, door actuator 321, FIG. 7A, is energized to pull on members 332, 323 and 325 and open support door 118; door 118 opens to its alternate position 118A, FIG. 7B. When gripper 151, in its return movement (arrow K, FIG. 7B) reaches a point at which the butt end of the food loaf is located over the dicharge gap between loaf supports 116 and 117, exposed by opening of door 118, the gripper is reverse energized to open its tines 332 and allow the butt end of the food loaf to drop down clear of the food path. Gripper 151 continues its return movement to the home position shown in FIG. 7A, door 118 is closed, and a new loaf is moved onto the food loaf path to start a new feed cycle. In machine 50, both grippers 151 may move back up to their home positions at about the same time and two (or more) new food loaves may be loaded into the slicing machine simultaneously at the beginning of each new feed/slicing cycle.

Figure 10:
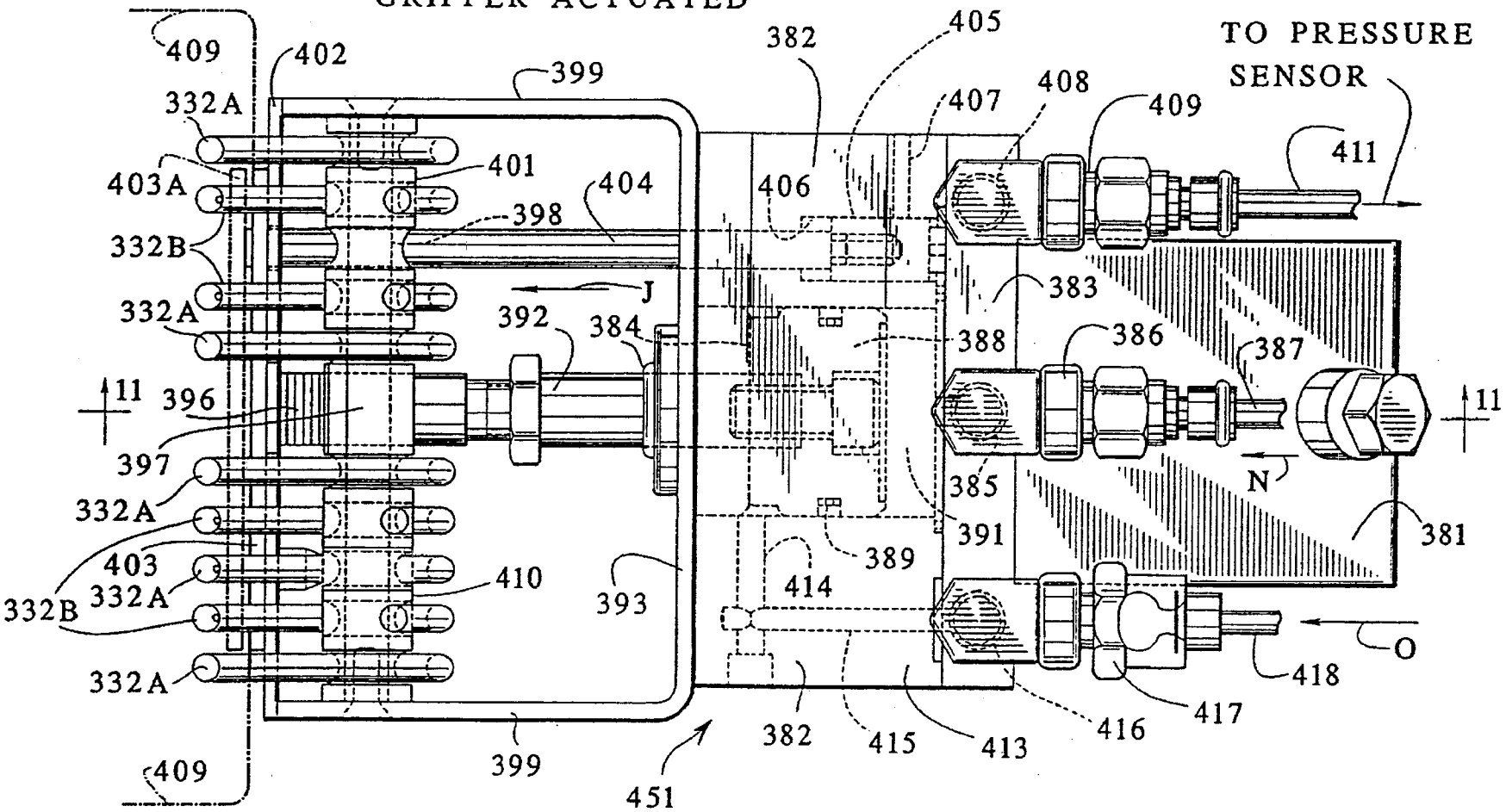
FIG. 10 is a plan view of a preferred construction for a gripper device used in the slicing machine of FIGS. 1–5.
Figure 11:
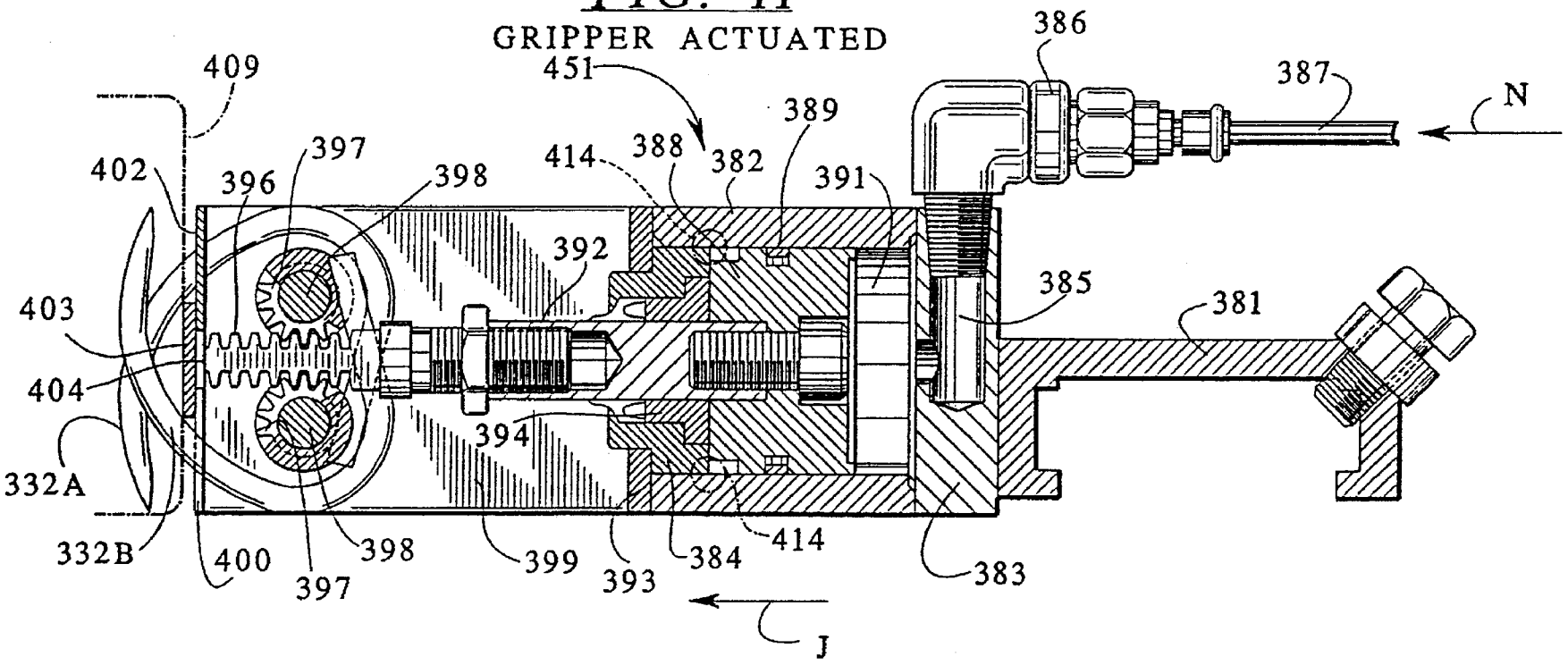
FIGS. 11 and 12 are section views, taken approximately along line 11—11 in FIG. 10, showing the gripper actuated and unactuated, respectively.
Figure 12:
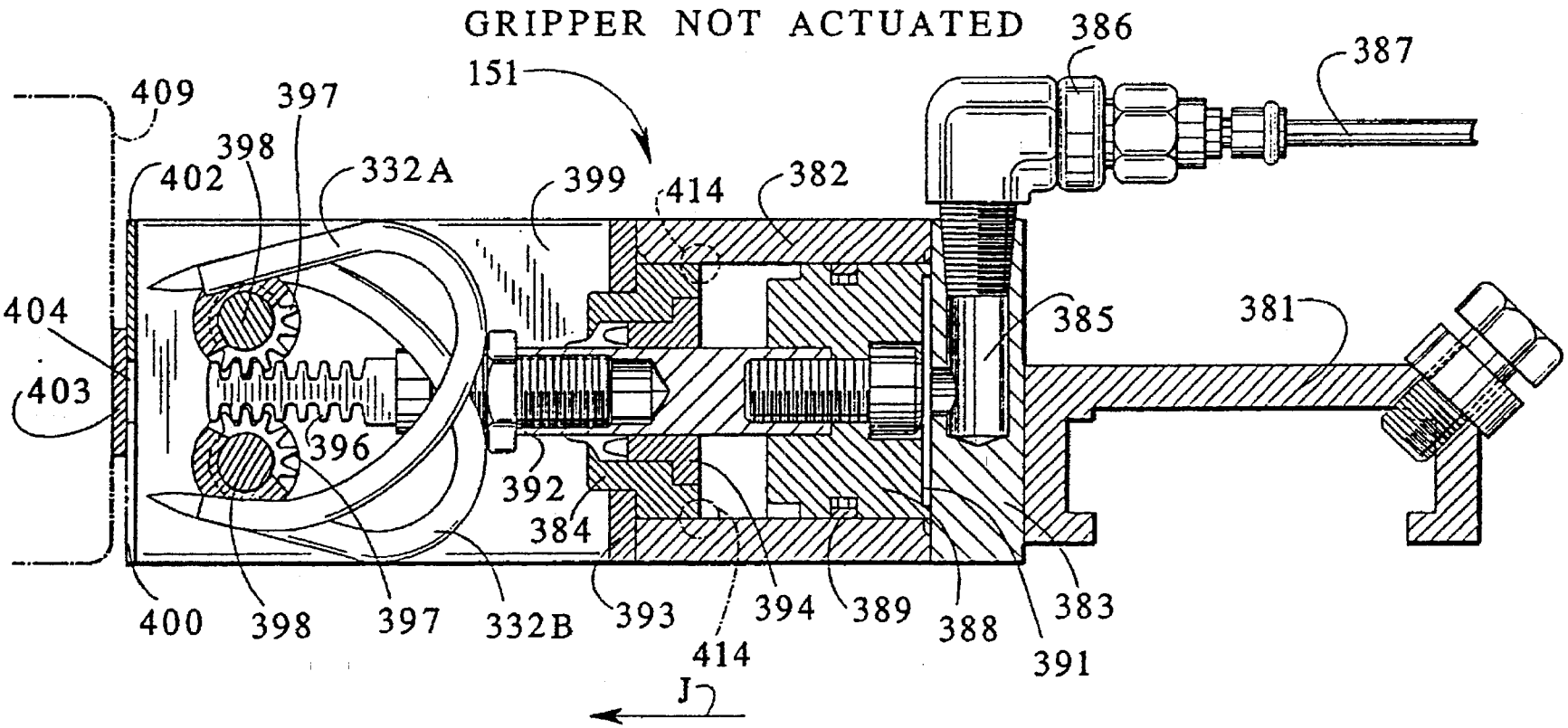

FIGS. 10–12 illustrate a low-profile gripper construction 451 that may be utilized for the grippers 151 shown generally in earlier figures. Gripper 451 includes a bracket 381 used to secure the gripper to a carriage extension 597 (see FIG. 7A). Gripper 451 (FIGS. 10–12) comprises a central housing or manifold 382 affixed to bracket 381 and closed at one end by a rear end plate 383. The central portion of manifold 382, as shown in FIG. 10, is closed by a front end plate 384.

The center portion of gripper 451, as shown in plan in FIG. 10 and in vertical section in FIGS. 11 and 12, includes an actuation air inlet passage 385. Passage 385 is connected to an elbow 386 which in turn is connected to a flexible air line 387. All of the air lines connected to gripper 451 should be flexible and are preferably coiled together; they must follow the gripper along its full movement, a distance in excess of four feet (over 102 cm). This is also true of other gripper constructions. A piston 388 is mounted in the central portion of gripper manifold 382. Piston 388 is provided with a seal 389. At the right-hand end of piston 388, as seen in the drawings, there is an inlet chamber 391 which is quite large in the gripper-actuated views of FIGS. 10 and 11 but is thin and small when the gripper is in the unactuated condition shown in FIG. 12.

The left-hand end of piston 388 (FIGS. 10–12) is connected to a piston rod 392. The outer end of piston rod 392, the left-hand end as seen in FIGS. 10–12, is connected to and supports, in cantilever fashion, a dual rack 396 that engages two gears 397 mounted on shafts 398. The two shafts 398 extend between the arms 399 of a bracket 393 mounted on manifold 382. There is a bushing 394 encompassing the end of piston rod 392 connected to piston 388 (FIGS. 10 and 11).

The two shafts 398 that span the arms 399 of bracket 393 also constitute supports for the tines 332A and 332B of gripper mechanism 451. There are two spools 401 and two spools 410; one of each is seen in FIG. 10. One spool 401 is mounted on one end of each shaft 398 and one spool 410 is mounted on the other end of each shaft. One spool 401 and one spool 410 is of integral, one piece construction with each spur gear 397, as shown in FIG. 10. Each spool 401 on the lower shaft 398 supports two tines 332A. There are three like tines 332A mounted on spool 410 on the other end of the lower shaft 398. The spool 401 on the upper shaft 398 supports two tines 332B; two more such tines 332B are affixed to and supported by the spool 410 on the other end of the upper shaft 398. Thus, one side of gripper mechanism 451 has four tines and the other side has five, as shown in FIG. 10.

Each of the tines of gripper mechanism 451 is aligned with an opening 400 in a fixed plate 402 that extends across and is mounted on the ends of the arms 399 of bracket 393; see FIGS. 11 and 12. Plate 402 also serves as a stop for a sensor plate 403 that is mounted upon the left-hand, outer end of a piston rod 404, as shown in FIG. 10. The other end of rod 404 is connected to a sensor piston 405 disposed within a chamber 406 in the upper third of manifold 382 as viewed from above in FIG. 10. Chamber 406 is in communication with a vent passage 407. Chamber 406 also communicates with a sensor air outlet 408 that corresponds generally in configuration to the actuation air inlet 385. Outlet 408 is connected to an elbow fitting 409 which is in turn connected to a pressure sensor (not shown) by a flexible air line 411.

Gripper mechanism 451 further comprises a retraction segment 413 which is in the lower third of manifold 382 as seen in FIG. 10. In this portion 413 of manifold 382 there are two air passages 414 and 415, connected in series, that lead to a retraction air inlet 416. Retraction air inlet 416 is incorporated in rear end plate 383 and may have the same configuration as the previously described actuation inlet 385 (FIGS. 11 and 12). Retraction air inlet 416, as shown in FIG. 10, is connected to an elbow 417. Fitting 417 is like the previously identified elbows 386 and 409 except that in this instance a female fitting is utilized instead of a male fitting to avoid possible erroneous air connections. Elbow 417 is connected to one end of a flexible air line 418.

In considering the operation of gripper 451, in the construction shown in FIGS. 10–12, at the outset sensor plate 403 is in the extended position 403A of FIG. 10. With the sensor plate in that position, passage 407 is open and vents chamber 406 in manifold 382 to the atmosphere. The pressure sensor (not shown) connected to line 411 recognizes that chamber 406 is at atmospheric pressure and this condition is signalled to the computer that controls slicing machine 50.

As previously described in connection with FIGS. 7–9, gripper 451, when substituted for gripper 151, is moved along its food path in the direction of arrow J until it comes into engagement with the end of a food loaf; the loaf end is represented in FIGS. 10–12 by phantom outline 409. Engagement of the gripper with the butt end of the food loaf forces the sensor plate from its original position 403A (FIG. 10) to the position 403 of FIGS. 10–12. At this juncture, the internal operating components in the center portion of manifold 382 are in their unactuated operating positions as illustrated in FIG. 12. That is, gripper 451 has not yet been actuated. Movement of the sensor plate to its position 403 drives piston rod 404 to the right, opposite arrow J, to the position illustrated in FIG. 10. As a consequence, sensor piston 405 closes off vent 407 and produces an elevated pressure condition in the outlet 408, 409 and the line 411 connected to the pressure sensor. This change in pressure, identified by the movements of sensor plate 403A, rod 404, and piston 405, is used to initiate actuation of gripper 451 from the unactuated condition shown in FIG. 12 to the actuated condition shown in FIGS. 10 and 11. Air is now supplied under pressure to the center portion of manifold 382 through line 387, as indicated by arrow N in FIGS. 10 and 11, and effects this change.

Air entering gripper 451 under pressure, as indicated by arrow N, through line 387, increases the pressure within inlet 385 and inlet chamber 391, driving piston 388 to the left to the position shown in FIGS. 10 and 11. As a consequence, piston rod 392 and rack 396 move to the left, in the direction of arrow J, from the unactuated position shown in FIG. 12 to the actuated, clamping position shown in FIGS. 10 and 11. The movement of rack 396 rotates gears 397 and their integral spools 401 and 410 so that tines 332A rotate in a counter-clockwise direction and tines 332B rotate in a clockwise direction from the positions shown in FIG. 12 to those shown in FIGS. 10 and 11. Accordingly, the tines of the gripper penetrate and clamp the end 409 of the new food loaf as illustrated in FIGS. 10 and 11. This actuated condition for gripper 451, FIGS. 10 and 11, is maintained throughout the time that the food loaf is being sliced.

When slicing of the food loaf is carried as far as possible, and gripper 451 reaches the limit position indicated by phantom outline 151A in FIG. 8, forward motion of the gripper in the direction of arrow J is stopped. The gripper 451 (and the other gripper in machine 50) is then retracted. When the grippers are over door 118, the supply of air under pressure through the actuation air inlet line 387 is shut off and air under pressure is introduced into line 418, as indicated by arrow 0 in FIG. 10. Air under pressure is thus introduced to the left-hand side of piston 388, as shown in FIGS. 10 and 11, and drives the piston back to the unactuated position shown in FIG. 12. This retraction operation for gripper 451 occurs at a time when the gripper is moving toward its home position (see gripper 151 in FIG. 7B), coincident with movement of the remaining unsliced butt end of the loaf over the gap in the food loaf path caused by opening of support door 118, as previously described. The resulting return motion of piston 388, rod 392 and rack 396 rotates shafts 398 and the spools 401 and 410, and thus rotates tines 332A and 332B back to the unactuated positions shown in FIG. 12. This withdraws the tines 332A and 332B from the small remaining butt end of the loaf and allows the butt end of the loaf to drop through door 118, clear of the support surface defining the bottom of the food path on which the loaf has been supported (FIG. 7B). With the loaf no longer in engagement with sensor plate 403 of gripper 451, that plate moves back to the position 403A shown in phantom outline in FIG. 10. When gripper 451 reaches its home position, as previously described, it is in unactuated condition (FIG. 12) ready for engagement with a new loaf on its loaf path.

There are two grippers in slicing machine 50; both of them may utilize the low-profile construction 451 illustrated in FIGS. 10–12. The two grippers usually open and close at the same time. However, they are independently operable to engage each food loaf on their respective sides of the machine and to drive that food loaf through the slicing head 66 in the manner previously described. The low-profile gripper construction of FIGS. 10–12 is pneumatically operated; hydraulic or electrical actuation could be employed if desired. The grippers used in slicing machine 50 should always have a height less than the loaves they drive, in order to preclude any gripper engaging either of the short input conveyors 163–166. The low-profile construction illustrated in FIGS. 10–12 is quite appropriate to and useful with a variety of food loaves, even relatively thin sides of bacon.

D. Loaf Loading Mechanisms, FIGS. 13 and 14

Figure 13:
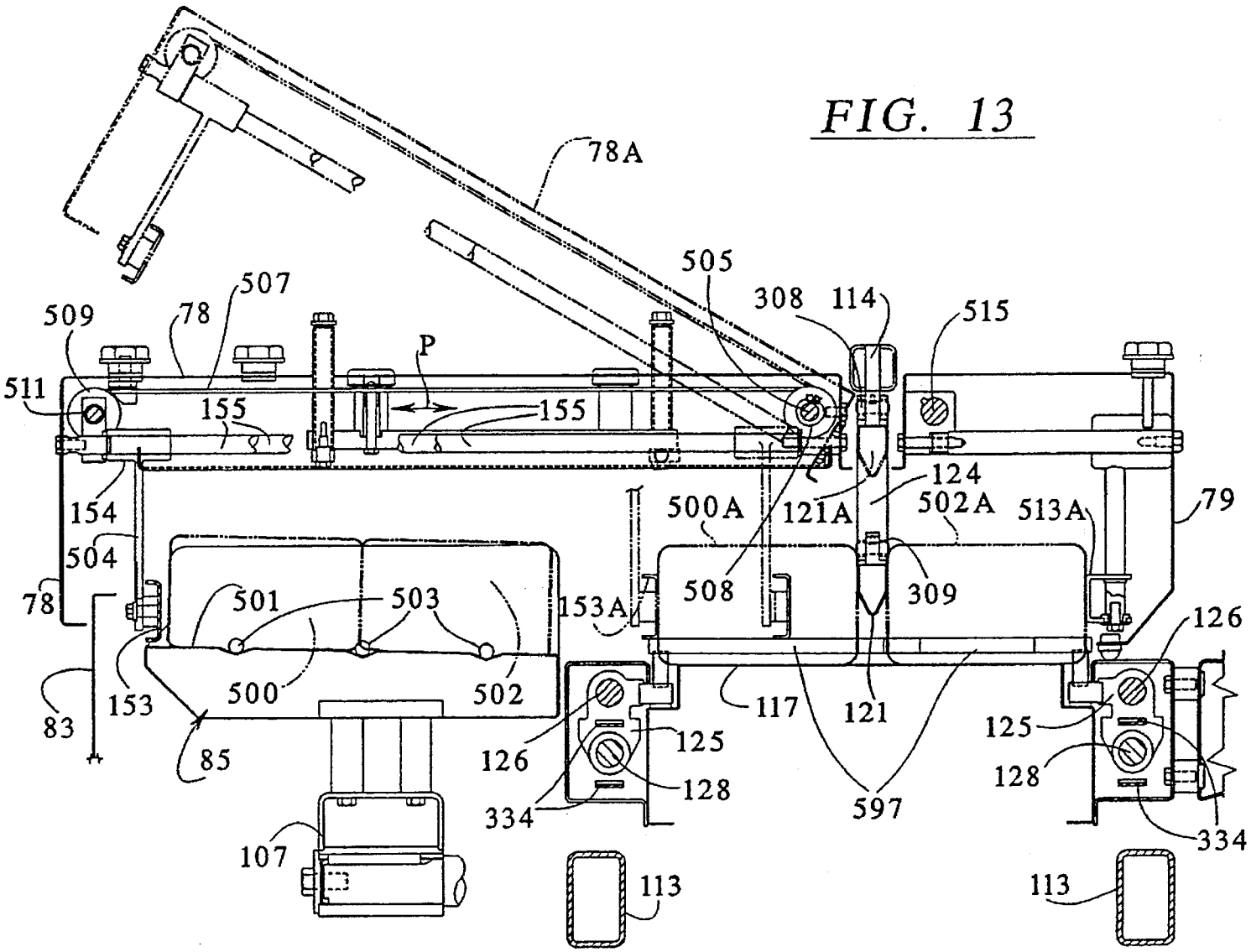
FIG. 13 is a sectional elevation view of the automated loaf feed mechanism, taken generally as indicated by line 13—13 in FIG. 7B.

FIG. 13 affords a sectional elevation view of the automated loaf loading mechanism on the near side of slicing machine 50, in a view taken approximately as indicated by line 13—13 in FIG. 7B. FIG. 13 includes many of the same components as shown in FIG. 5, in FIG. 7B, and in other figures of the drawings.

In FIG. 13 loaf loading tray 85 is shown in an operating position to which it is driven by loaf lift mechanism 107 during automated loading of a food loaf into the slicing machine. The upper surface 501 of tray 85, on which two new feed loaves 500 and 502 are supported, has a series of longitudinal drainage depressions 503 that also serve as loaf troughs for small diameter food loaves. The upper surface 501 of tray 85 may be fabricated of textured sheet steel. Loaves 500 and 502 are shown as rectangular loaves having the maximum cross-sectional size acceptable in the slicing machine for slicing of two loaves. In the loaf loading condition shown in FIG. 13, the upper surface 501 of tray 85 is aligned slightly above and inclined slightly downwardly toward the top surface of loaf support 117, on which the new loaves are to end up, on the machine's food loaf paths, in the positions indicated by phantom outline 500A and 502A. The inclination of surface 501 facilitates loading the new loaves into the slicing machine.

In the portion of the automated loaf loading mechanism shown in solid lines in FIG. 13, door 78 is closed, overlapping the top of guard 83. Door 78 supports the operating mechanism for sweep 153, which is suspended from two carriages 154 each mounted on two shafts 155 as shown in FIG. 3; only one carriage 154 and one suspension member 504 are shown in FIG. 13. Door 78 is pivotally mounted on a shaft 505 that runs the length of load mechanism 75 (FIGS. 1–3); door 78 is in the position shown in solid lines in FIG. 13 but is pivoted (clockwise in FIG. 13) to an alternate loaf load position 78A during clean-up of machine 50.

Sweep carriage 154, which slides along two shafts 155, is connected to an elongated timing belt 507. At one end, belt 507 engages a drive pulley 508; drive pulley 508 is affixed to a shaft 505. The other, outer end of belt 507 engages an idler pulley 509 on a shaft 511 that is parallel to shaft 505.

At the beginning of an automated loaf loading operation the loaf loading tray 85 is moved up to the position shown in FIG. 13, aligning new loaves 500 and 502 on tray surface 501 with the support 117 on which the loaves rest while being sliced. The drive for pulley 508 and shaft 505 operates to drive the upper run of belt 507 to the left, in FIG. 13, in the direction indicated by arrows P. This moves the lower run of belt 507 toward the center of the slicing machine, to the right as seen in FIG. 13. The belt movement drives carriage 154 and suspension member 504 to the right along shafts 155 and moves sweep 153 toward and past its position 153A, pushing the new loaves 500 and 502 into the slicing machine until the movement of loaf 502 is interrupted at position 502A with that loaf engaging a guide at position 513A at the opposite side of the machine. While this loaf loading operation is going forward, the center barrier 121 is elevated, clear of the loaf paths to its position 121A. Thus, the two new loaves 500 and 502 are in contact with each other, as shown on tray 85 in FIG. 13, during this part of the loading cycle.

At this point in the automated loaf loading cycle, sweep 153 is backed off to the left, as seen in FIG. 13, and the center barrier 121 is driven down from its elevated position 121A to position 121 between the two new loaves. The downward movement of barrier 121 drives one loaf to position 500A on the left-hand food loaf path; the loaf in position 502A is already aligned on the right-hand food loaf path. The grippers of the slicing machine are now moved down the loaf paths into engagement with the two new food loaves and barrier 121 is again elevated to position 121A where it is clear of the air lines that are connected to the grippers. This completes the automated loaf loading operation.

Figure 14:
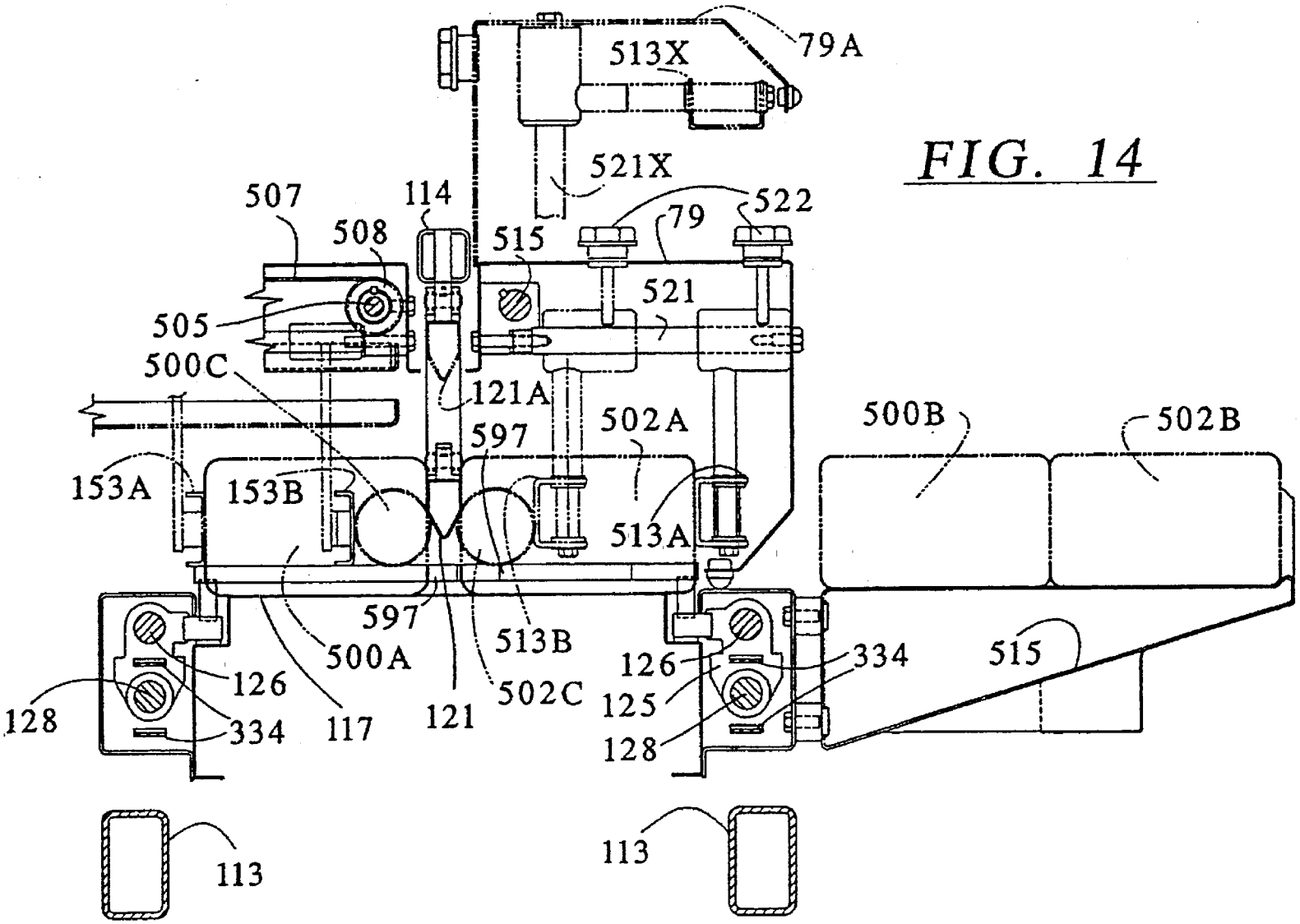
FIG. 14 is a sectional elevation view of the manual loaf feed mechanism, taken at about the same location as FIG. 13.

FIG. 14 is a cross-sectional view of the manual food loaf loading mechanism on the far side of slicing machine 50, as shown in FIGS. 1–3. FIG. 14 is taken approximately on the same plane as FIG. 13. It includes a stationary loaf storage tray 515 supporting two new food loaves in positions 500B and 502B, ready to be loaded into the slicing machine.

The manual loading mechanism of the slicing machine, FIG. 14, includes the manual loaf door 79, which is mounted on a rotatable shaft 515 that is parallel to shaft 505. During slicing, door 79 is closed, in the position shown in solid lines in FIG. 14. At the beginning of a manual feed cycle, however, door 79 is pivoted to its alternate operating position 79A. With the door in position 79A, the manual guide 513 is in position 513X, where it does not and cannot interfere with manual loading of new loaves into the slicing machine.

At this point in the manual loaf loading operation, the machine operator moves one loaf from support tray 515 to position 500A on loaf support 117, engaging the automated-side sweep 153 in its position 153A. The machine operator then moves the other new loaf from support 515 to approximately position 502A. It is not necessary for the operator to align the new food loaves precisely on the food loaf paths; at this juncture in the manual loaf loading operation the door is manually pivoted from its open position 79A to its closed position 79, pivoting the manual side guide from its elevated position 513X to its position 513A. Moreover, the center barrier is driven down from its elevated position 121A to its position 121, accurately aligning the new food loaves on the food paths on support 117 (and its related supports 116 and 118, FIGS. 7A and 7B). From this point on the manual loaf loading operation is essentially the same as the automated loaf loading operation described above (FIG. 13), with the grippers engaging the new food loaves and barrier 121 returning to its elevated operating position 121A clear of the food loaves.

In FIGS. 13 and 14 the end positions for sweep 153A and guide 513A are shown as they would be for slicing two rectangular loaves of the maximum size acceptable in the slicing machine when slicing two loaves. The food loaves to be sliced are frequently smaller in cross-section, and may be round; see outlines 500C and 502C in FIG. 14. Sweeps 153 and 513 must be adjustable, as to their final positions, to accommodate the smaller loaves. On the manual side of the loaf feed mechanism 75, this adjustment is made by mounting the guide on a normally horizontal guide shaft 521. A manual adjustment 522 allows for movement of the guide to any location between two limit positions 513A and 513B to accommodate loaves of different sizes. There are two such adjustments 522 (see FIG. 3); only one appears in FIG. 14. A similar adjustment, for the sweep 153 in the automated loaf feed, adjusting the end position for that sweep between limits 153A and 153B, FIG. 14, is provided.

Figure 15:
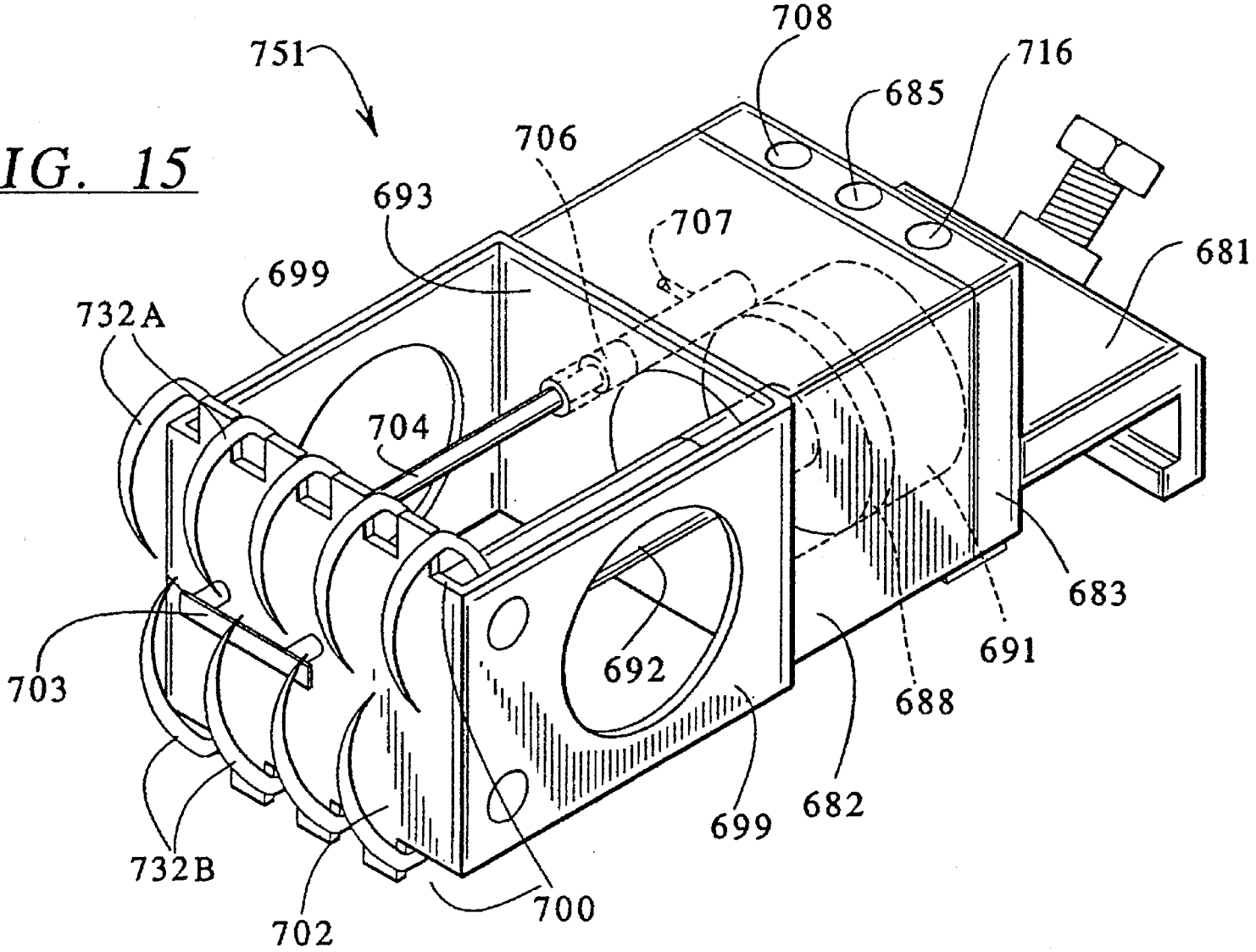
FIG. 15 is a perspective view of a gripper used in the slicing machine.
Figure 16:
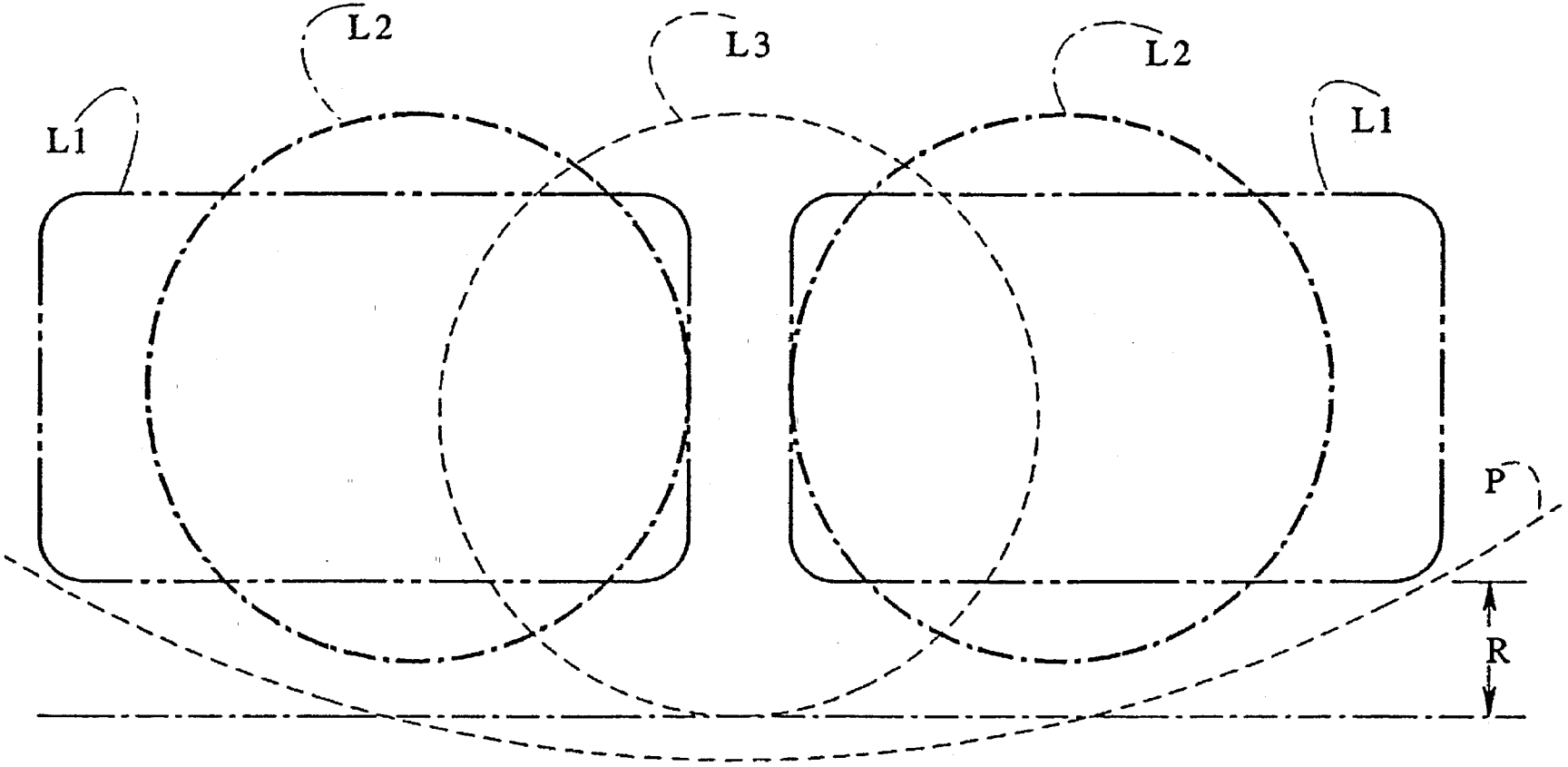
FIG. 16 is an explanatory diagram of slicing level variations in the slicing machine.

E. Miscellaneous; FIGS. 15 and 16

FIG. 15 is a perspective view of a loaf gripper 751 having a construction like that shown generally in FIGS. 3 and 7A. As shown in FIG. 15, gripper 751 comprises a manifold 682 closed at its rear (right-hand) end by a plate 683 in which there are three bores 685, 708 and 716. Plate 683 is affixed to a mounting base 681 for mounting the gripper on a horizontal arm 597 of a gripper carriage 125; see FIG. 5.

Within manifold 682, FIG. 15, there is a chamber 691 for a piston 688; chamber 691 is connected to bore 685 in plate 683. Piston 688 has an operating rod 692 that projects through an opening in a rectangular bracket or frame 693 having opposed sides 699 and an outer end plate 702. The outer end of piston rod 692 is operatively connected to a series of upper tines 732A and a corresponding series of lower tines 732B; the operational connection (not shown) may be the same as or similar to the connection between piston rod 392 and tines 332A and 332B in the gripper 451 shown in FIGS. 10–12. Each of the tines 732A and 732B is aligned with a slot 700 in plate 702. As seen in FIG. 15, tines 732A and 732B are in their actuated, loaf-gripping positions.

Gripper 751, FIG. 15, further includes a loaf sensor bar 703 mounted on the outer end of a sensor rod 704 connected to a piston 706 in an air pressure chamber in manifold 682. The chamber for piston 706 has a lateral vent 707 to the atmosphere and also is connected to bore 708 in closure plate 683, to allow for connection to an air pressure sensor (not shown). The remaining bore 716 in the end plate 683 of manifold 682 is connected to the front end of piston 688 by passages not illustrated.

Operation of gripper 751, FIG. 15, is essentially the same as previously described for gripper 451, FIGS. 10–12. Accordingly, that description need not be repeated. The principal difference between the two grippers is that gripper 451 (FIGS. 10–12) has a lower profile than gripper 751 (FIG. 15) and hence may be desirable for food loaves of small cross section or for slicing thin food products such as bacon slabs.

FIG. 16 illustrates three typical loaf cross-section outlines L1, L2, and L3 that may be sliced in slicing machine 50. The two outlines L1 are illustrative of rectangular loaves approximately four inches 102 mm) in height by six and one-half inches (165 mm) in width. Generally comparable round loaves, illustrated by the two outlines L2, are five and one-half inches (140 mm) in diameter. The single centrally located loaf outline L3 has a diameter of six inches (152 mm). To slice all three effectively, with a knife blade edge that traverses a path P in each slicing cycle, it is desirable to provide a range R of about 1.31 inches (33 mm) for adjustment of the height of the support 117 at the end of the loaf paths that enters the slicing station of the machine. Thus, by providing for adjustment of the height of the lower end of the loaf feed mechanism, at the entrance to the slicing station, a wide variety of food loaf sizes and configurations can be accommodated without modification or adjustment of the slicing station mechanism.

In slicing machine 50, although many of the various rotary and linear actuators could be hydraulically actuated, pneumatic actuation is preferred. This minimizes possible contamination of the output of the slicing machine that could arise from a break in a hydraulic line. Of course, for some of the rotary actuators, such as those that drive the slicing station mechanism, electrical servo motors are desirable.

We claim:

1. An improved high speed food loaf slicing machine comprising a slicing station including a knife blade and a knife blade drive driving the knife blade along a predetermined cutting path, and loaf support means for supporting a first food loaf and a second food loaf for movement along parallel first and second loaf paths, respectively, into the slicing station for repetitive slicing of both loaves by the knife blade, the improvement comprising:

a first loaf feed drive for advancing the first food loaf along the first loaf path at a first preselected loaf feed rate, the first loaf feed drive including two driven short feed conveyors firmly engaging opposite sides of a first food loaf on the first loaf path immediately ahead of the slicing station;

a second loaf feed drive for advancing the second food loaf along the second loaf path at a second preselected loaf feed rate, the second loaf feed drive including two driven short feed conveyors firmly engaging opposite sides of a second food loaf on the second loaf path immediately ahead of the slicing station;

an elongated barrier aligned between and parallel to the first and second loaf paths;

barrier displacement means for displacing the barrier between a first position between food loaves on the food paths and a second position clear of food loaves on the food paths;

a first gripper releasably gripping the first food loaf, on the first loaf path, at the end of the first food loaf remote from the slicing station;

first gripper drive means for driving the first gripper along the first loaf path at the first loaf feed rate;

a second gripper releasably gripping the second food loaf, on the second food path, at the end of the second food loaf remote from the slicing station;

second gripper drive means for driving the second gripper along the second loaf path at the second loaf feed rate;

means for driving each gripper to a home position at the end of its loaf path remote from the slicing station prior to the aforesaid movement of the gripper along its loaf path toward the slicing station; and means for varying one loaf feed rate independently of the other so that slices cut from one loaf can differ in thickness from slices cut from the other.

2. An improved high speed food loaf slicing machine according to claim 1, in which the improvement further comprises:

a first loaf storage tray for storing a food loaf ready for transfer to the loaf path; and first loaf transfer means for moving a food loaf from the first loaf storage tray to the first loaf path.

3. An improved high speed food loaf slicing machine according to claim 2 in which the first loaf storage tray has a textured upper surface on which the food loaf is stored.

4. An improved high speed food loaf slicing machine according to claim 2, in which the first loaf storage tray and the first loaf transfer means are located on one side of the slicing machine, the improvement further comprising:

a second loaf storage tray for storing a food loaf ready for transfer to the second loaf path; and second loaf transfer means for moving a food loaf from the second loaf storage tray to the second loaf path;

the second loaf storage tray and second loaf transfer means being located on the opposite side of the slicing machine from the first loaf storage tray and the first loaf transfer means.

5. An improved high speed food loaf slicing machine according to claim 2, in which the first loaf storage tray and the first loaf transfer means constitute an automated loaf loading mechanism, located on one side of the slicing machine, the improvement further comprising:

a manual loaf loading mechanism located at the opposite side of the machine from the automated loaf loading mechanism, the manual loaf loading mechanism including a cover for the second loaf path and means for raising that cover upon completion of slicing of a food loaf on the second loaf path.

6. An improved high speed food loaf slicing machine according to claim 1, in which the barrier displacement means maintains the barrier in its second position when the food loaves are being sliced.

7. An improved high speed food loaf slicing machine according to claim 1, in which the barrier is of V-shaped cross-sectional configuration.

8. An improved high speed food loaf slicing machine according to claim 1, in which the improvement further comprises:

an elongated sweep parallel to the first loaf path and in spaced parallel relation to the barrier;

and sweep drive means, connected to the sweep, for displacing the sweep between a first sweep position in which the sweep engages one side of a food loaf, displaced from the barrier, on a loaf path, and a second sweep position clear of the loaf paths.

9. An improved high speed food loaf slicing machine according to claim 8 in which the improvement further comprises:

adjustment means to adjust the end of the loaf support means immediately adjacent the slicing station over a limited vertical range of about two inches (five cm) to accommodate food loaves of varying height.

10. An improved high speed food loaf slicing machine according to claim 8, in which:

the sweep, in moving from its second sweep position to its first sweep position, first moves to an intermediate sweep position adjacent to but spaced from the first food loaf, and subsequently moves from its intermediate position to its first sweep position.

11. An improved high speed loaf slicing machine according to claim 1 in which the improvement further comprises:

first and second loaf doors, each mounted for pivotal movement between a blocking position blocking access of a food loaf to the knife blade on one food loaf path and an inactive position clear of that path;

and first and second door actuation means to actuate each of the first and second food loaf doors between its blocking and inactive positions.

12. An improved high speed loaf slicing machine according to claim 11 in which the first and second door actuation means are operationally independent of each other.

13. An improved high speed food loaf slicing machine comprising a slicing station including at least one knife blade and a knife blade drive driving the knife blade along a predetermined cutting path, and loaf support means for supporting a first food loaf and a second food loaf for movement along parallel first and second loaf paths, respectively, into the slicing station for repetitive slicing of both loaves, the improvement comprising:

a first loaf feed drive for advancing the first food loaf along the first loaf path at a first preselected loaf feed rate;

a second loaf feed drive for advancing the second food loaf along the second loaf path at a second preselected loaf feed rate;

each loaf feed drive including a pair of short conveyors engaging opposite sides of a food loaf immediately ahead of the slicing station and means for biasing the pair of short conveyors toward each other;

means for varying one load feed rate independently of the other so that slices cut from one loaf can differ in thickness from slices cut from the other;

two grippers, one on each food path, each gripper releasably gripping a food loaf at the end of that food loaf remote from the slicing station;

means for driving each gripper along its loaf path at the same speed as the two short feed conveyers associated with that food path;

means for driving each gripper to a home position at the end of its loaf path remote from the slicing station prior to the aforesaid movement of the gripper along its loaf path toward the slicing station;

an elongated barrier aligned between and parallel to the first and second loaf paths; and barrier displacement means for displacing the barrier between a first position between food loaves on the food paths and a second position clear of food loaves on the food paths.

14. An improved high speed food loaf slicing machine according to claim 13, in which the improvement further comprises:

a first loaf storage tray for storing a food loaf ready for transfer to a loaf path; and first loaf transfer means for moving a food loaf from the first loaf storage tray to a loaf path.

15. An improved high speed food loaf slicing machine according to claim 13, in which the barrier is of V-shaped cross-sectional configuration.

16. An improved high speed food loaf slicing machine according to claim 13, in which the improvement further comprises:

an elongated sweep parallel to the first loaf path and in spaced parallel relation to the barrier;

and sweep drive means, connected to the sweep, for displacing the sweep between a first sweep position in which the sweep engages one side of a food loaf, displaced from the barrier, on the first loaf path, and a second sweep position clear of the loaf paths.

17. An improved high speed food loaf slicing machine according to claim 16, in which:

the sweep, in moving from its second sweep position to its first sweep position, first moves to an intermediate sweep position adjacent to but spaced from the first food loaf, and subsequently moves from its intermediate sweep position to its first sweep position.

18. An improved high speed food loaf slicing machine according to claim 16 in which the improvement further comprises:

adjustment means to adjust the end of the loaf support means immediately adjacent the slicing station over a limited vertical range of no more than two inches (five cm) to accommodate food loaves of varying height.

19. An improved high speed food loaf slicing machine according to claim 13 in which the loaf support means comprises:

first and second aligned, fixed supports separated from each other, in a direction parallel to the food paths, by a discharge space;

a third loaf support movable between a normal closed position in which the third support fills the discharge space and an open position in which the discharge space is open between the first and second supports;

and actuating means for moving the third support member to its open position following completion of slicing of a food loaf and subsequently returning that third support to its normal closed position.

20. An improved high speed food loaf slicing machine according to claim 19 in which each of the loaf supports has a textured upper surface.

21. An improved high speed food loaf slicing machine according to claim 19 in which:

the loaf support means is mounted in the slicing machine for movement between a normal support position, in which the loaf support means is inclined upwardly from the slicing station and masks the loaf feed drives, and a cleanup position in which the loaf support means exposes the loaf feed drives for cleanup access; and the loaf support means is pivotally mounted, for movement between its normal support position and its cleanup position, along a pivotal axis transverse to the food paths and adjacent the slicing station.

22. An improved high speed food loaf slicing machine according to claim 19 in which:

each loaf feed drive includes a gripper releasably gripping an end of a food loaf on one associated food path remote from the slicing station, a drive belt driving the gripper from a home position toward the slicing station and back to its home position, and gripper actuation means for actuating the gripper between a loaf gripping condition and a release condition;

the gripper actuation means for each gripper actuating that gripper to its release condition when the gripper passes the discharge space during movement of the gripper to its home position.

* * * * *